US007789499B2

(12) United States Patent
Iwanaga et al.

(10) Patent No.: US 7,789,499 B2
(45) Date of Patent: Sep. 7, 2010

(54) INK JET PRINT HEAD AND METHOD OF MANUFACTURING INK JET PRINT HEAD

(75) Inventors: Shuzo Iwanaga, Kawasaki (JP); Yasuhiko Osaki, Kawasaki (JP); Akira Yamamoto, Yokohama (JP); Riichi Saito, Fujisawa (JP); Toshiaki Hirosawa, Hiratsuka (JP); Yasutomo Watanabe, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 12/054,638

(22) Filed: Mar. 25, 2008

(65) Prior Publication Data

US 2008/0239004 A1 Oct. 2, 2008

(30) Foreign Application Priority Data

Mar. 30, 2007 (JP) ..... 2007-092428

(51) Int. Cl.
*B41J 2/045* (2006.01)

(52) U.S. Cl. ..... 347/72

(58) Field of Classification Search ..... 347/72; 438/21

See application file for complete search history.

(56) References Cited

U.S. PATENT DOCUMENTS

2007/0285469 A1* 12/2007 Sato et al. ..... 347/63

FOREIGN PATENT DOCUMENTS

| | | | |
|---|---|---|---|
| JP | 61-016862 | A | 1/1986 |
| JP | 10-044418 | A | 2/1998 |
| JP | 11-192705 | A | 7/1999 |
| JP | 2002-086742 | A | 3/2002 |

OTHER PUBLICATIONS

Suganuma, Takatoshi et al. (WO 2006/112526), published Oct. 26, 2006 in English, entire document.*

* cited by examiner

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

An ink jet print head is provided which allows an ejection opening-formed surface to be cleaned well and can improve a precision with which ejected ink lands on a print medium. For this purpose, conductive layers of a conductive material are formed on the support substrate and planarized. The liquid ejection substrates are mounted on the support substrate with high precision, without a sealing agent, that protects electrical connecting portions on the liquid ejection substrates, protruding from the ejection opening-formed surface.

16 Claims, 28 Drawing Sheets

INK JET PRINT HEAD AND METHOD OF MANUFACTURING INK JET PRINT HEAD

BACKGROUND OF THE INVENTION

FIELD OF THE INVENTION

The present invention relates to a print head used in a printing apparatus that ejects ink to perform a printing operation and more particularly to an ink jet print head using a laminated ceramic substrate and to a method of manufacturing the ink jet print head.

A printing system used in common ink jet printing apparatus employs either an electrothermal transducing element, such as a heater, or a piezoelectric element as an ink ejection energy generation element. Some of these ink jet print heads (hereinafter referred to simply as print heads) have a liquid ejection substrate in which a nozzle for ejecting ink droplets and a print element such as an electrothermal transducing element are integrated.

Regarding a connection between the liquid ejection substrate and an electric wiring substrate that supplies electric power to the liquid ejection substrate, Japanese Patent Publication No. 8-25272 (1996) and Japanese Patent Laid-Open No. 10-044418 (1998) have disclosed a print head which has a reduced size and a lowered production cost and is capable of performing a reliable, high-quality printing.

FIG. 23 is a perspective view showing a print head using conventional electrothermal transducing elements. FIG. 24 is a schematic view showing an ink ejection portion and associated parts of the print head of FIG. 23. FIG. 25 is a cross-section taken along the line XXV-XXV of FIG. 24.

A liquid ejection substrate 101 of a print head 100 has ejection openings 105, electrothermal transducing elements (not shown) and electronic circuit elements (not shown). Electrodes 107 formed on the surface of the liquid ejection substrate 101 are connected, through a metal-to-metal bonding or thermocompression bonding using ILB (Inner Lead Bonding), to electrodes 108 of an electric wiring substrate 103 that supplies electric control signals to the liquid ejection substrate 101. These connection electrodes are covered with a sealing agent 110 to protect them against ink and a wiping action of a rubber blade that wipes off ink droplets and dirt such as paper dust adhering to a print head surface formed with the ejection openings 105. The liquid ejection substrate 101 has an ink supply path and is securely bonded by adhesive 111 with a support substrate 102 so that their ink supply paths communicate with each other.

In the conventional ink jet print head with the connecting portions sealed with the sealing agent, the electric connecting portions (sealed portions) between the liquid ejection substrate sealed with the sealing agent and the electric wiring substrate protrude from the ejection opening-formed face of the print head. To prevent the protruding, sealed portions from coming into contact with a print medium during printing, a distance from the ejection opening-formed surface of the print head to the print medium needs to be increased by an amount corresponding to the protruding sealing agent. Increasing the gap between the print head face and the print medium contributes to degrading a precision with which an ink droplet ejected from the ejection opening lands on the print medium. Further, since the sealed portion protrudes from the ejection opening-formed surface, it becomes a hindrance to the wiping operation performed to remove ink droplets and dirt such as paper dust adhering to the print head face. This makes it difficult to remove dirt such as paper dust completely from the print head face, giving rise to a possibility of degrading the print quality.

To solve this problem, Japanese Patent Laid-Open No. 11-192705 (1999) discloses a wide array ink jet apparatus in which the liquid ejection substrate has electric connection electrodes formed on its surface opposite the surface formed with ejection openings.

FIG. 26 and FIG. 27 show a wide array ink jet pen 210 described in Japanese Patent Laid-Open No. 11-192705 (1999). FIG. 26 is a perspective view of the wide array ink jet pen with a wide array print head. FIG. 27 is a cross-sectional view of one part of FIG. 26 showing an electric connecting portion in the wide array ink jet print head of FIG. 26 including a print head die and a support substrate 220.

The pen 210 is comprised of a wide array print head 212 and a pen body 214. The pen body 214 is a housing on which the print head 212 is mounted. The pen body 214 has an internal chamber 216 as an ink tank. The print head 212 also has a plurality of print heads 218 mounted on the support substrate 220. The print heads 218 have electrodes 284 for making electrical connections and an ink supply port 242, both formed on a back side thereof which is opposite the surface formed with the nozzle openings 238. The support substrate 220 to support the print heads 218 has electric wirings on a first surface 270 and a second surface 272 thereof. On the first surface 270 the electric wirings are connected with the print heads 218 through solder bumps. Logic circuits and a drive circuit 230 (not shown) are laid on the second surface 272 opposite the first surface 270 of the substrate 220.

As a support substrate for such print heads, a construction using a laminated ceramic substrate has been proposed. However, the laminated ceramic substrate generally has a poor planarity because it is sintered at high temperature in the manufacturing process. If the planarity of the support substrate is bad, a precision with which the liquid ejection substrate is mounted on the support substrate is also degraded. This in turn lowers a precision with which ink droplets land on a print medium, giving rise to a possibility of a degraded print quality.

If a laminated ceramic substrate with a bad planarity is used as a support substrate for the print head of a back surface mounting type in which the back electrodes of the liquid ejection substrate and electrodes of the support substrate are directly joined such as Japanese Patent Laid-Open No. 11-192705 (1999), correct electrical connections may not be obtained, resulting in electrical failures.

As a method of improving the planarity of the support substrate which has a bad planarity, Japanese Patent No. 3,437,962 discloses a method that involves forming a planarization layer 34 on the substrate 32, planarizing the planarization layer 34 by grinding or lapping and then mounting the liquid ejection substrate on the planarized layer.

FIG. 28 shows a cross section of a print head of the Japanese Patent No. 3,437,962. A planarization layer 2801 is formed of a nonconductive layer such as ceramics. Electrical connections are made by wire bonding between electrode pads 2804 of a liquid ejection substrate 2802 and electrode pads 2803 on a support substrate 2805 provided at openings in the nonconductive planarization layer 2801.

The ink jet print head of the Japanese Patent No. 3,437,962, however, cannot cope with the back surface mounting because this print head has the liquid ejection substrate mounted on the planarized nonconductive layer. So, the connection between the support substrate and the liquid ejection substrate is made through the wire bonding as in the conventional method. So, the connecting portions need to be sealed and the sealed portions naturally protrude from the liquid ejection substrate. This requires increasing the gap between the ejection opening-formed surface of the print head and a print medium by an amount corresponding to the height of the protruding sealing agent, degrading a precision of ejected ink landing on a print medium. Further, the protruding sealing agent lumps prevent dirt such as paper dust from being removed completely, which in turn will lead to degraded print quality.

SUMMARY OF THE INVENTION

It is therefore an object of this invention to provide an ink jet print head which has the liquid ejection substrate mounted on the support substrate with high precision, without the sealing agent, that is designed to protect the electrical connecting portions on the liquid ejection substrate, protruding from the ejection opening-formed surface and which therefore allows the ejection opening-formed surface to be cleaned well and improves a precision with which ejected ink droplets land on a print medium.

According to this invention, an ink jet print head comprises: liquid ejection substrates having back surface electrodes on a surface thereof opposite a surface formed with ink ejection openings; and a support substrate having electrode terminals and supporting the liquid ejection substrates; wherein the back surface electrodes of the liquid ejection substrates and the electrode terminals of the support substrate are electrically connected together through a plurality of conductive layers; wherein the conductive layers of at least one liquid ejection substrate are arranged so that their upper surfaces are on the same plane with the support substrate taken as a reference.

According to this invention, a method of manufacturing an ink jet print head, including liquid ejection substrates formed with ink ejection openings and a support substrate supporting the liquid ejection substrates, wherein back surface electrodes of the liquid ejection substrates and electrode terminals of the support substrate are electrically connected together through a plurality of conductive layers, comprises the steps of: forming the conductive layers so that their surfaces constitute one and the same plane with the support substrate taken as a reference; and mounting the liquid ejection substrates on the same plane.

With this invention, a conductive layer of a conductive material is formed on the support substrate and subjected to planarization processing, and the liquid ejection substrate is mounted on the planarized surface. This improves the mounting precision of the liquid ejection substrate and therefore a print quality. Further, since the sealing agent covering the connecting portions on the liquid ejection substrate does not protrude from the ejection opening-formed surface of the print head, the gap between the ejection opening-formed surface and the print medium can be reduced, eliminating the difficulties the protruding sealing agent has posed in the conventional method. This in turn allows for good cleaning of the print head face and improved print quality.

Further features of the present invention will become apparent from the following description of exemplary embodiments (with reference to the attached drawings).

DESCRIPTION OF THE EMBODIMENTS

First Embodiment (Basic Construction)

Now, a first embodiment of this invention will be described by referring to the accompanying drawings.

Figure 1:
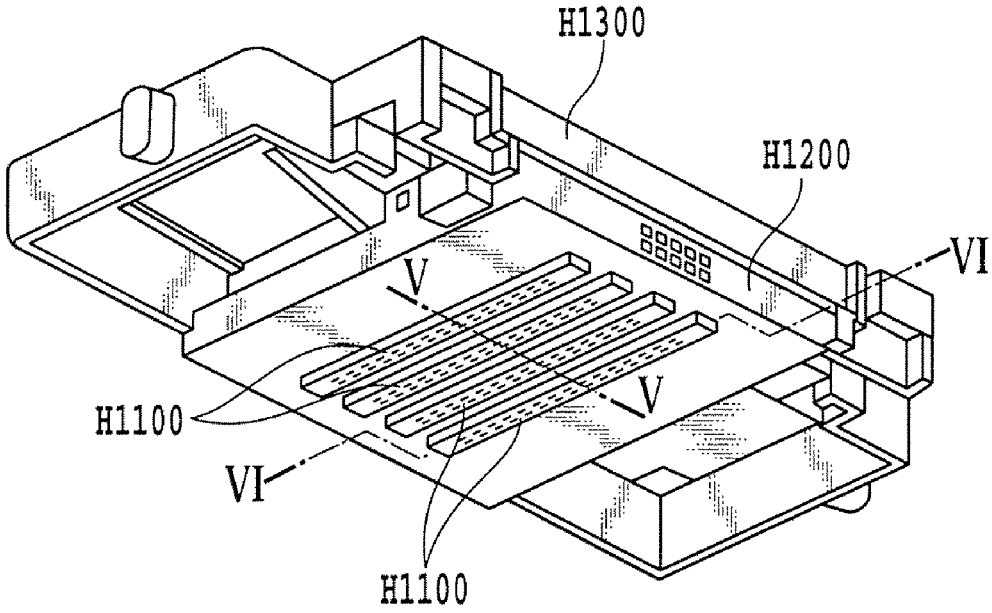
FIG. 1 is a perspective view of an ink jet print head as a first embodiment of this invention.
Figure 2:
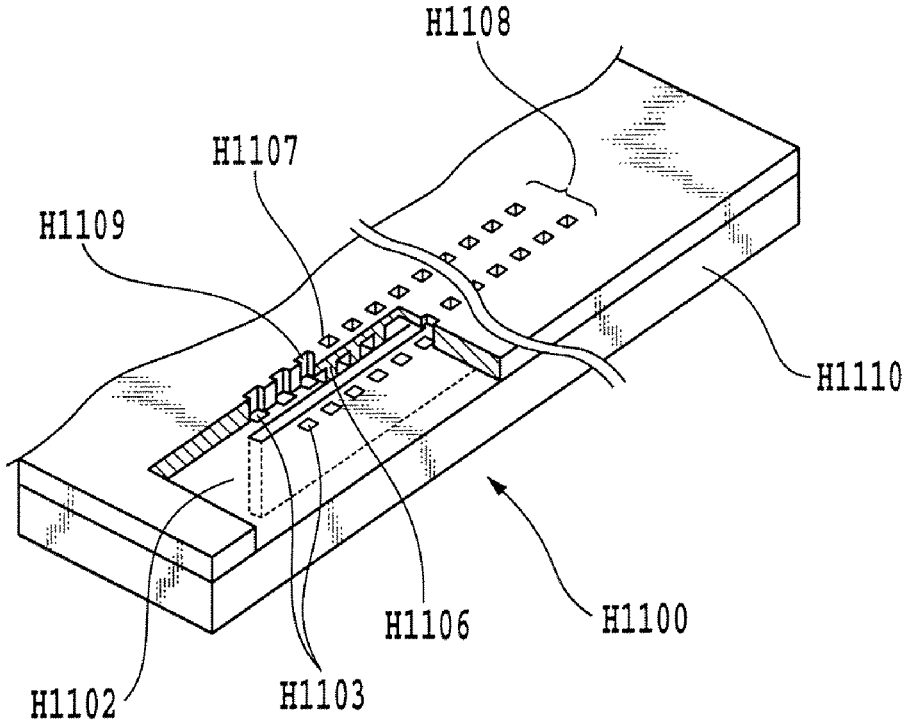
FIG. 2 is a partially enlarged perspective view of a liquid ejection substrate used in the print head of FIG. 1.
Figure 3:
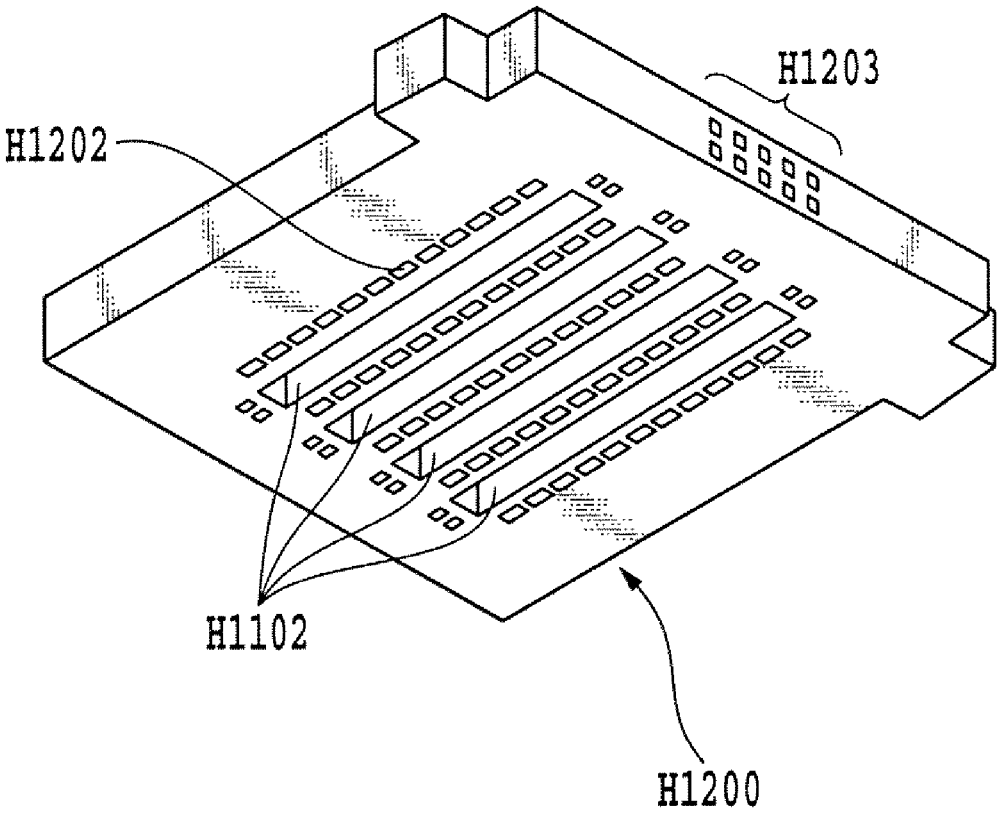
FIG. 3 is a perspective view of a support substrate of FIG. 1.
Figure 4:
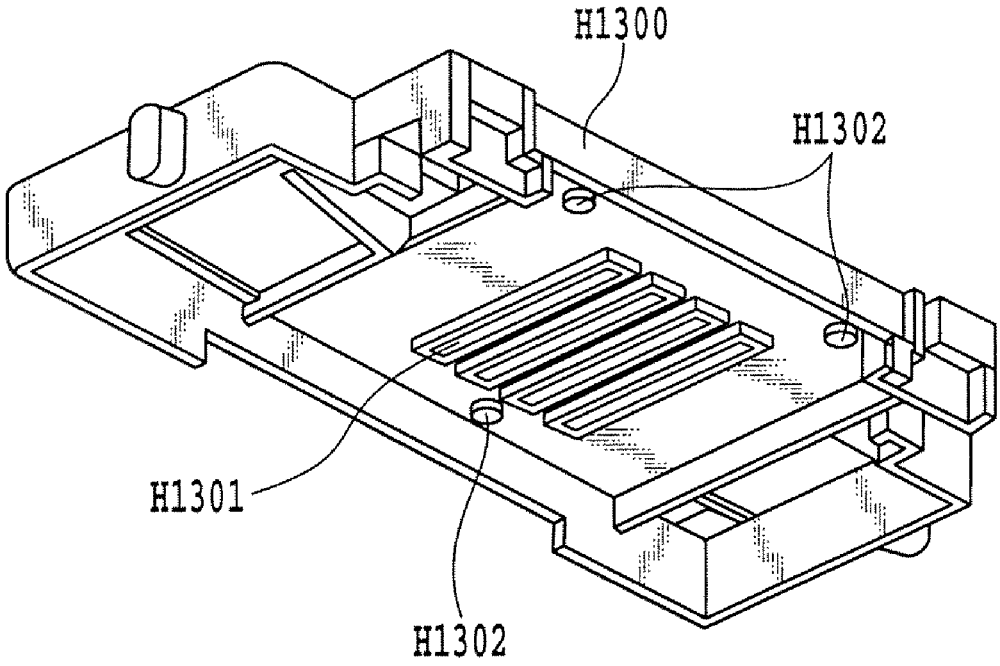
FIG. 4 is a perspective view of an ink supply member of FIG. 1.
Figure 5:
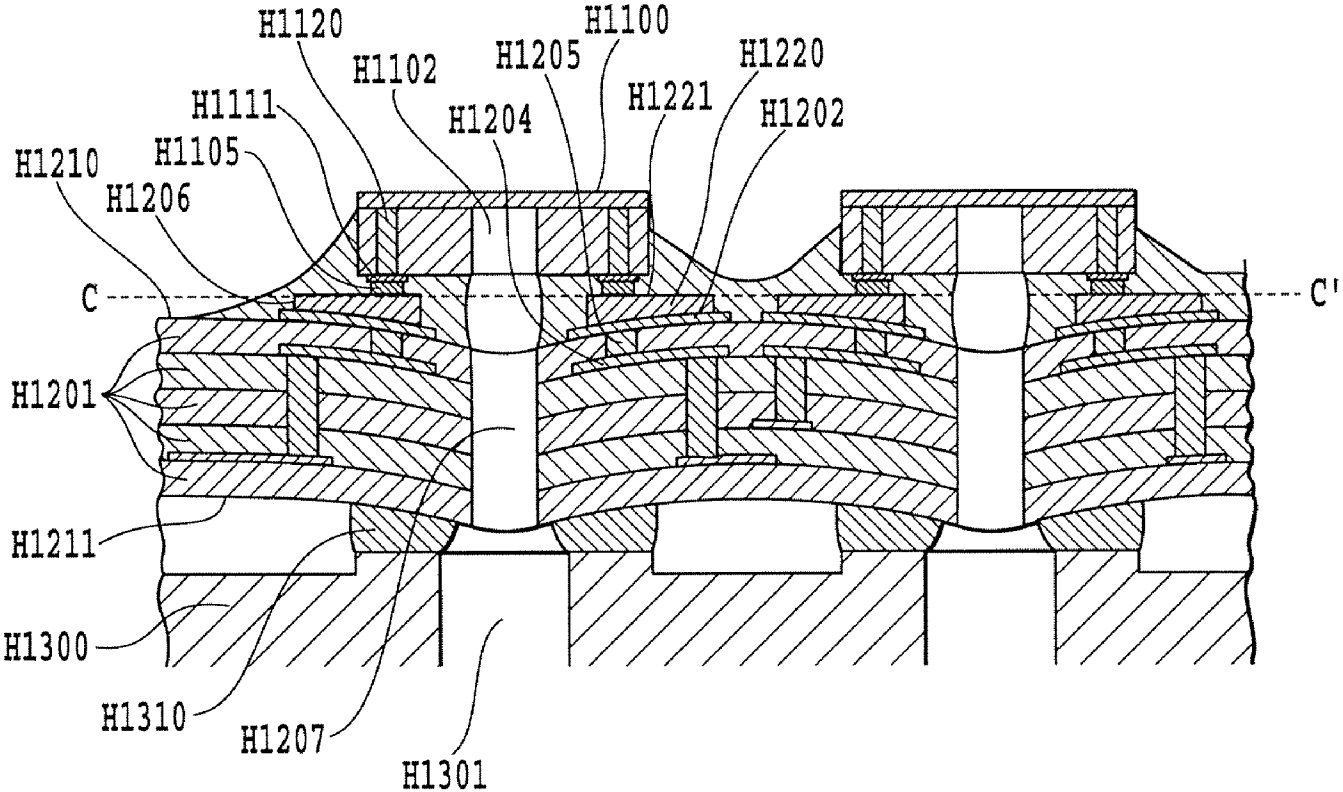
FIG. 5 is a schematic cross-sectional view taken along the line V-V of FIG. 1.
Figure 6:
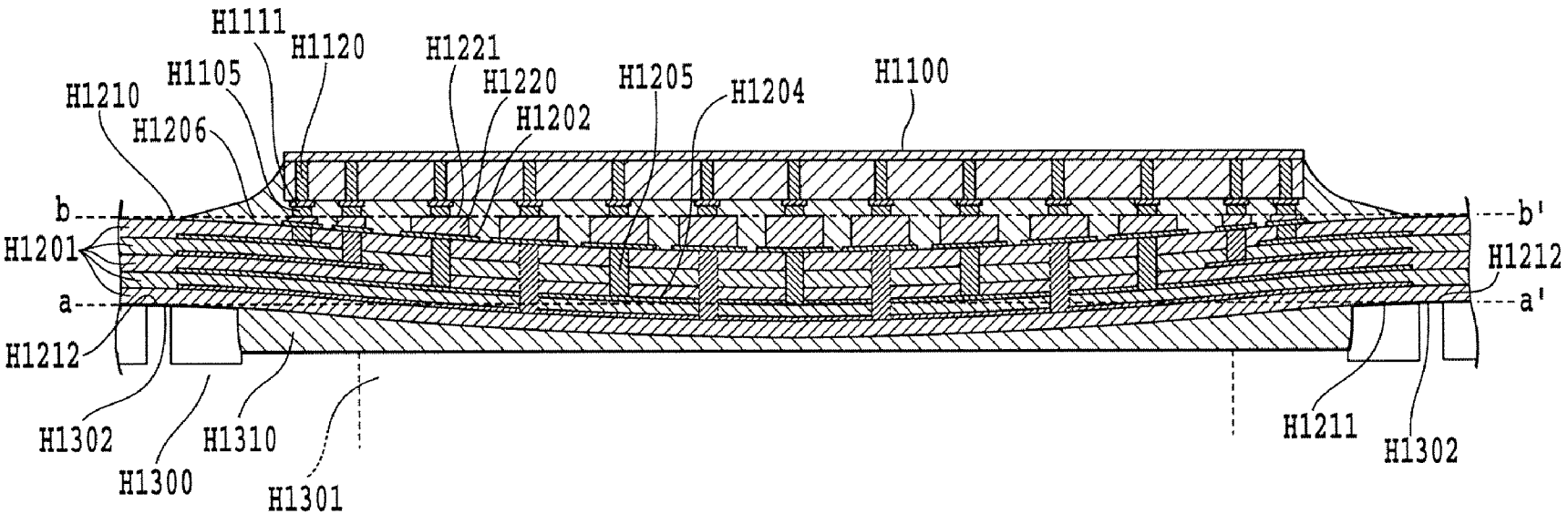
FIG. 6 is a schematic cross-sectional view taken along the line VI-VI of FIG. 1, the line running in a direction of an ejection opening array and along a reference plane of an ink supply member in the liquid ejection substrate.
Figure 7:
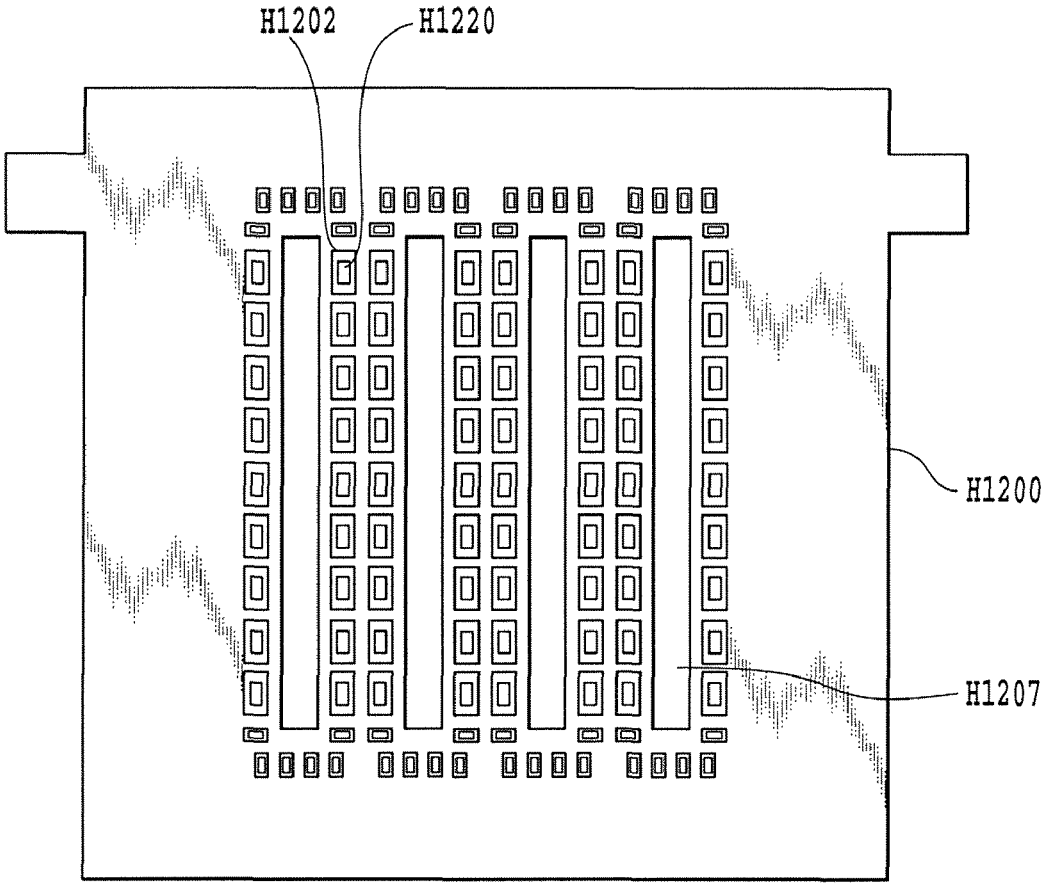
FIG. 7 is a plan view of a conductive layer formed on the support substrate of FIG. 1, as seen from the support surface side of the liquid ejection substrate.

FIG. 1 is a perspective view showing an ink jet print head (also referred to simply as a print head) as a first embodiment of this invention. FIG. 2 is a partly enlarged perspective view of a liquid ejection substrate H1100 used in the print head of FIG. 1. FIG. 3 is a perspective view of a support substrate H1200 of FIG. 1. FIG. 4 is a perspective view of an ink supply member H1300 of FIG. 1. FIG. 5 is a schematic cross-sectional view taken along the line V-V of FIG. 1. FIG. 6 is a schematic cross-sectional view taken along the line VI-VI of FIG. 1, the line running in a direction of an ejection opening array and along a reference plane of an ink supply member H1300 in the liquid ejection substrate H1100. FIG. 7 is a plan view of a conductive layer H1220 formed on the support substrate H1200 of FIG. 1, as seen from the support surface side of the liquid ejection substrate H1100.

The print head of this embodiment includes a support substrate H1200, a conductive layer H1220 formed on the support substrate H1200, a liquid ejection substrate H1100 mounted on the conductive layer H1220 and an ink supply member H1300.

The print head is held and supported by a positioning means provided in a carriage (not shown) mounted in a body of the ink jet printing apparatus (also referred to simply as a printing apparatus) and by electric contacts. The carriage is movable in a direction crossing the print medium feed direction. Further, the print head is removably attached with an ink tank (not shown), which can be replaced with a new one when the tank runs out of ink.

On the surface of the liquid ejection substrate H1100 ejection openings H1107 for ejecting ink are formed, as shown in FIG. 2. The ejection openings H1107 are arrayed in two or more lines to form an ejection opening array H1108. On the back side of the liquid ejection substrate H1100 is formed a liquid supply port H1102 for supplying ink, which extends in the direction of array of the ejection openings H1107 over a distance almost equal to the length of the ejection opening array H1108. Ink from the liquid supply port H1102 enters into a bubble forming chamber H1109 (liquid chamber) where it stays temporarily. In the bubble forming chamber H1109, an electrothermal transducing element H1103 as an ejection energy generation means creates an air bubble in ink to eject ink from the ejection opening H1107. Further, on the back side of the liquid ejection substrate H1100 are formed a plurality of back side electrode terminals H1111 to send electric signals to the electrothermal transducing elements H1103. The back side electrode terminals H1111 are connected to an electric circuit on the front side of the liquid ejection substrate H1100 through a wire piercing through the liquid ejection substrate H110.

Below the liquid ejection substrate H1100 is arranged a support substrate H1200 with the conductive layer H1220 in between. The support substrate H1200 is a laminated ceramic substrate composed of a plurality of laminated ceramic sheets H1201, as shown in FIG. 5 and FIG. 6. On the front surface of the support substrate H1200, electrode terminals H1202 for supplying a drive signal to the liquid ejection substrate H1100 are formed around a liquid supply port H1207. On the side surface, side surface electrode terminals H1203 for receiving electric signals from the printing apparatus body are formed (see FIG. 3). Further, the support substrate H1200 is warped convex on the surface where the liquid ejection substrate H1100 is not mounted, with a longitudinally central part of the liquid supply port H1207 as a vertex. The electrode terminals H1202 and the side surface electrode terminals H1203 are connected together by internal conductive wires H1204 running in the support substrate H1200 and by via holes H1205 filled with a conductive material.

Further, the support substrate H1200 is formed with a liquid supply port H1207 extending from the front surface of the substrate to the back. The ink supply member H1300 bonded together with the support substrate H1200 is also formed with a liquid supply port 1301. With these members connected together and the liquid supply ports communicating with each other, ink supplied from the ink tank flows through the ink supply member H1300 to the liquid supply port H1207, the liquid supply port H1102 and then to the bubble forming chamber H1109 in the liquid ejection substrate H1100.

Ceramics used in the support substrate H1200 need only be chemically stable when exposed to ink. It is further desirable that the liquid ejection substrate H1100 can dissipate heat that is generated by ink ejection. Among materials that meet the above requirements are alumina, aluminum nitride, mullite and low temperature co-fired ceramics (LTCC). Wiring materials used for the support substrate H1200 need only be able to come into intimate contact with the ceramics. Possible materials include W, Mo, Pt, Au, Ag, Cu, and Pt—Pd.

(Characteristic Construction)

Figure 8:
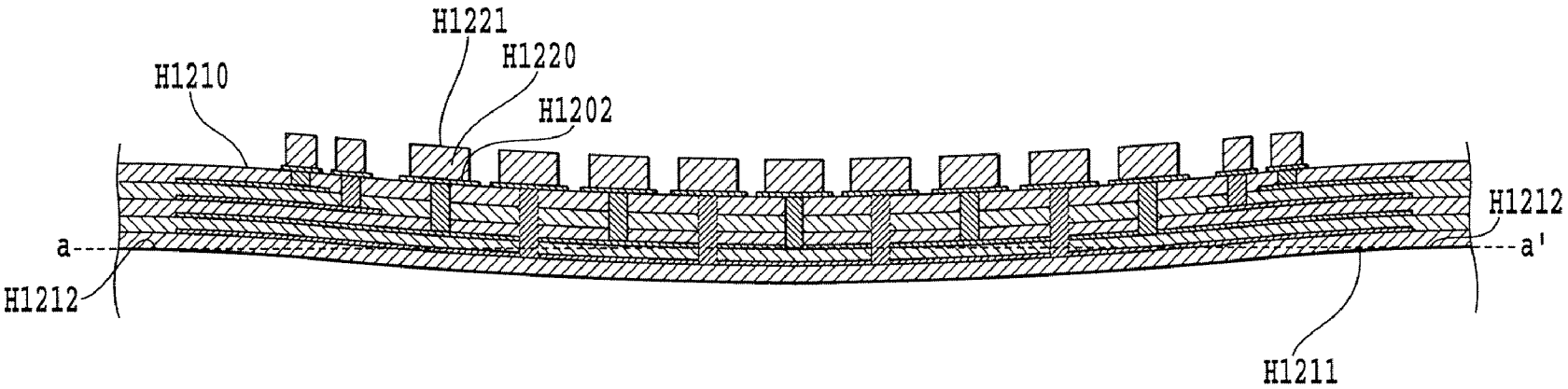
FIG. 8 is a schematic cross-sectional view of a conductive layer formed on the support substrate, as seen from the direction of an ejection opening array.
Figure 9:
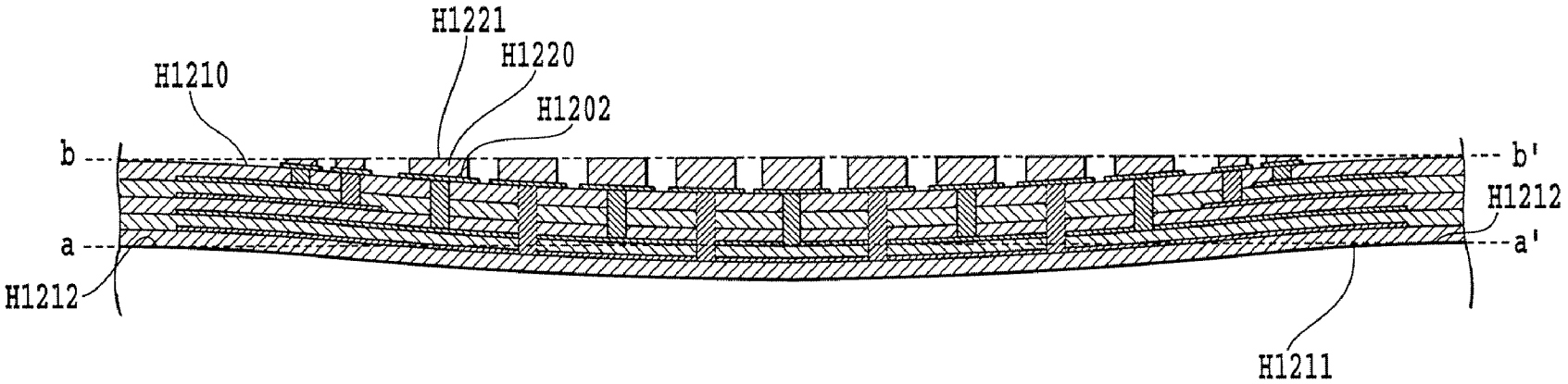
FIG. 9 is a schematic cross-sectional view of a conductive layer formed on the support substrate after the conductive layer has been planarized.

FIG. 8 is a schematic cross-sectional view, taken along the direction of the ejection opening array, of the conductive layer H1220 formed on the support substrate H1200. FIG. 9 is a schematic cross-sectional view of the conductive layer H1220 formed on the support substrate H1200 after the conductive layer H1220 is planarized. In this embodiment, after the conductive layer H1220 is formed over the electrode terminals H1202 provided on the curved surface of the support substrate H1200, as shown in FIG. 8, the surface of the conductive layer H1220 to which the liquid ejection substrate H1100 is bonded is planarized. This construction will be detailed as follows.

The support substrate H1200 has a first surface H1210 on a side where the liquid ejection substrate H1100 is mounted. On this first surface H1210 are formed electrode terminals H1202, over which the conductive layer H1220 is formed. The conductive layer H1220 is formed of a conductive material, as by applying a conductive paste to the electrode terminals H1202. Possible conductive particles for the conductive paste include Ag, Ag—Pd, Cu, Au, Pt, W and Mo. The conductive pastes are generally available in two types—a firing type and a hardening type. The firing type of conductive paste is heated at a relatively high temperature to eliminate a resin content through dissolution and sublimation and to fasten together the conductive particles through melting. The hardening type of the conductive paste is heated to harden a resin content to hold the conductive particles together by a contraction force of the resin. Either type of the conductive paste may be used.

The thickness of the conductive layer H1220 is determined according to the planarity of the support substrate H1200. The only requirement for the application of the conductive layer H1220 is that the thickness of the conductive layer H1220 after hardening and firing be greater than a maximum amount of warping of the support substrate H1200. Further, since the conductive layer H1220 after being hardened or fired is subjected to grinding, the application of the conductive layer H1220 should consider the margin of thickness that is to be eliminated by grinding. One example of application thickness of the conductive paste follows. When the maximum warping of the support substrate H1200 is 40 μm, the thickness of the conductive layer H1220 after being grinded needs to be at least 40 μm. So, considering a thickness margin for grinding, the thickness of the hardened conductive layer H1220 before grinding is set to more than 50 μm. If the conductive layer reduces by 50% by contraction due to firing, the application thickness of the conductive paste needs to be 50 μm×2=100 μm or more. The hardened conductive paste is planarized by grinding or grinding, as shown in FIG. 9. As a result of this planarization processing, the upper surfaces of a plurality of individual conductive layers H1220 are on the same plane, forming a flat surface H1221.

The support substrate H1200 has a second surface H1211 on a side opposite the one where the liquid ejection substrate H1100 is mounted. The second surface H1211 is a surface to be bonded with the ink supply member H1300. The second surface H1211 is provided with at least three reference points H1212. With the reference points H1212 of the second surface as a reference, the conductive layers H1220 of at least one liquid ejection substrate H1100 are planarized. So, imaginary planes defined by at least the three reference points and the flat surface H1221 of the conductive layers H1220 are parallel.

Further, the reference points H1212 on the second surface are provided to match a reference surface H1302 of the ink supply member H1300 of FIG. 4 and serve as a reference in bonding the support substrate H1200 and other parts such as the ink supply member H1300 (see FIG. 6). When the liquid ejection substrate H1100 is mounted on the flat surface H1221, the reference points H1212 on the second surface are also taken as a reference to ensure that the ink supply member H1300 and the liquid ejection substrate H1100 are parallel. That is, a-a' and b-b' in FIG. 6 are parallel and a-a' of FIG. 6 and c-c' of FIG. 5 are parallel, allowing for precise landing of ink droplets.

In this embodiment a contact area between the conductive layers H1220 and the electrode terminals H1202 is made smaller than the electrode terminals H1202. This construction is advantageous in preventing a shortcircuit between the electrode terminals H1202 and the conductive layer H1220 or between the conductive layers H1220 when the intervals of the electrode terminals H1202 are narrow.

As shown in FIG. 9, the liquid ejection substrate H1100 is mounted on the flat surface H1221 of the planarized conductive layer H1220 and electrically connected to the conductive layer H1220 through bumps H1105. The electrode terminals H1202 that contact the liquid ejection substrate H1100 through the conductive layer H1220 are used to send electric signals. They may also be used to dissipate to the support substrate H1200 the heat generated in the liquid ejection substrate H1100 by ink ejection operation. The electric connection may be accomplished by bonding through metal bumps, such as gold bumps, or by pressure-bonding the electrodes using conductive adhesives or thermosetting adhesives. The thermosetting adhesives may contain conductive particles.

Further, the electric connections are sealed with a sealing agent H1206 (or adhesive) for protection against corrosion by ink or from impacts of a rubber blade during cleaning. Ink in the liquid supply port H1207 is completely isolated from the outside, except through the ejection openings, to prevent ink leakage to the outside.

If the support substrate is warped so that it is most recessed at the central part of the liquid ejection substrate, the thickness of the conductive layer is largest at the central part, as shown in FIG. 6. This construction is advantageous when the electrode terminals and bumps are used for heat dissipation as described above. This is explained as follows. Heat fluxes produced by the ink ejection in the liquid ejection substrate H1100 are highest at the longitudinally central part of the liquid ejection substrate. The heat tends to be transmitted faster through the conductive layer and more easily dissipated to the support substrate as the thickness of the conductive layer increases. For this reason, the thickness of the conductive layer at the easily heated central part of the liquid ejection substrate is increased. This allows heat dissipation to proceed uniformly in the liquid ejection substrate, which in turn renders the volumes of ink droplets ejected from individual ejection openings uniform, resulting in an improved printing performance.

Example Variations

A first variation of the first embodiment is explained by referring to the accompanying drawings.

Figure 10:
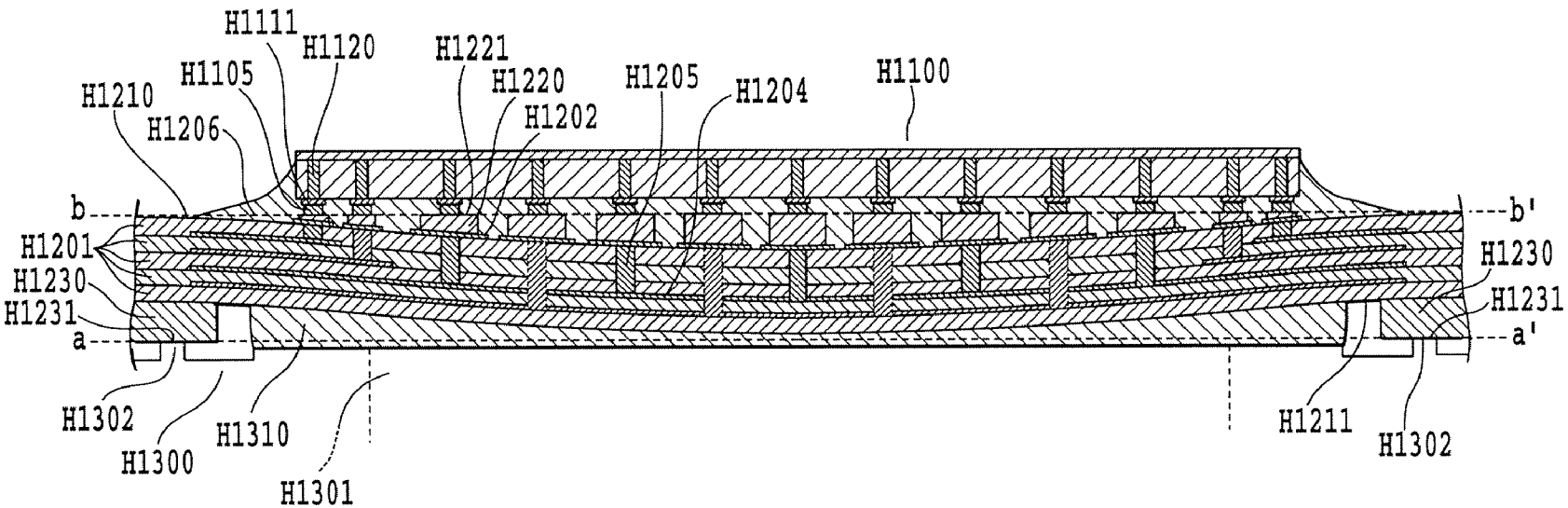
FIG. 10 shows a print head as a variation of the first embodiment.

FIG. 10 shows a print head as a variation of the first embodiment. The print head of this variation has a second conductive layer H1230 formed also on the second surface H1211. As with the conductive layer H1220, the second conductive layer H1230 of a conductive paste is, after being solidified, similarly planarized as by grinding to form a second flat surface H1231. In this variation, the second conductive layer H1230 is not supplied electricity and is used as a dummy to form the second flat surface H1231. It is also possible to use the second conductive layer H1230 in place of the side surface electrode terminals H1203 of the support substrate H1200. The second flat surface H1231 serves as a reference plane for bonding together the support substrate H1200 and the ink supply member H1300. With the second flat surface H1231 used as a reference when grinding the conductive layer H1220, a parallelism of the conductive layer can be secured. Further, the second flat surface H1231 may also be used as a reference for bonding the support substrate H1200 to the ink supply member H1300 or as a reference for mounting the liquid ejection substrate H1100.

A construction such as this variation is suitably applied where the second surface H1211 of the support substrate H1200 is greatly warped so that references are difficult to set in the second surface H1211. The second conductive layer H1230 may first be planarized before planarizing the conductive layer H1220 of the first surface. Or two conductive layers may be planarized simultaneously as by a double-sided grinding method. If two conductive layers are to be planarized at the same time, they are preferably formed of the same material to secure the same grinding rate and thereby facilitate the planarization operation. Further, making the conductive layer's areas on both sides equal (as by using a dummy pattern) allows for a well-balanced grinding on two sides, facilitating the planarization operation.

A second variation of the first embodiment will be explained by referring to the accompanying drawings.

Figure 11:
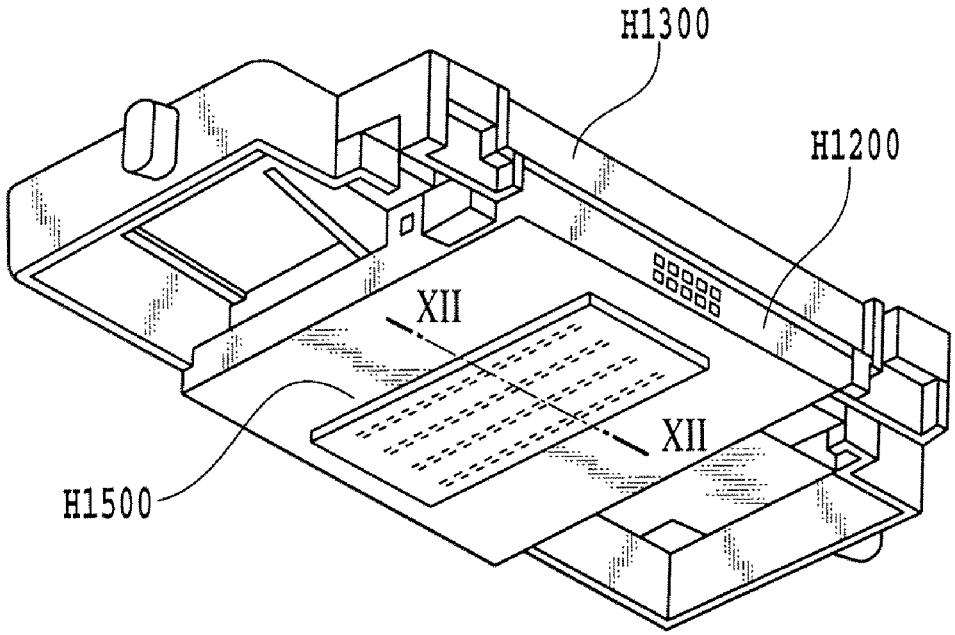
FIG. 11 is a perspective view of a print head incorporating a multicolor-integrated liquid ejection substrate.
Figure 12:
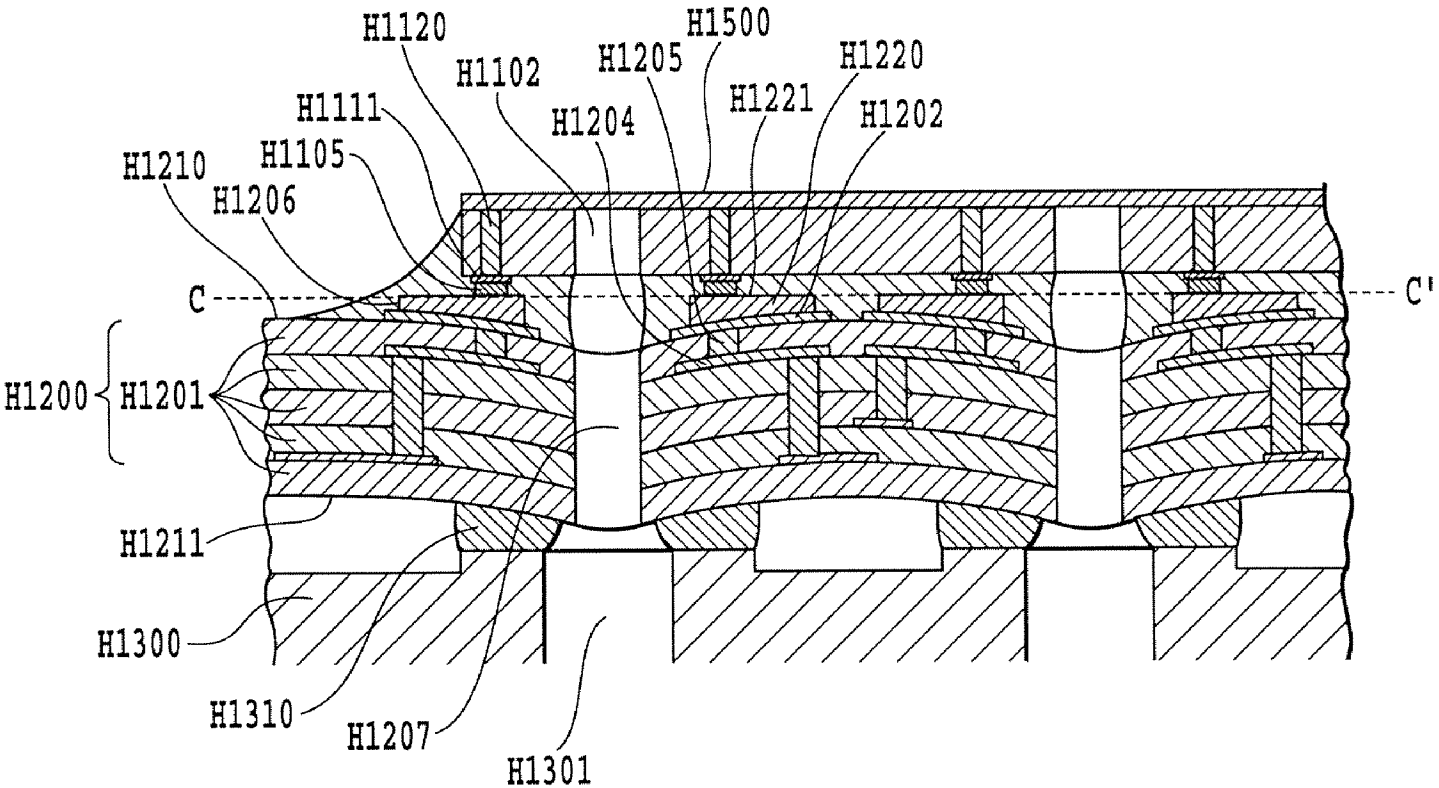
FIG. 12 is a schematic cross-sectional view taken along the line XII-XII of FIG. 11.

FIG. 11 is a perspective view of a print head incorporating a multicolor-integrated liquid ejection substrate H1500. FIG. 12 is a schematic cross-sectional view taken along the line XII-XII of FIG. 11.

The print head of the second variation has a plurality of liquid supply ports formed in one liquid ejection substrate H1500. This allows for a multicolor printing by one liquid ejection substrate H1500. It is true that the multicolor printing can be done by mounting on the support substrate H1200 a plurality of liquid ejection substrates with a single liquid supply port. However, the use of the multicolor-integrated type has cost advantages of being able to reduce a total substrate area because of smaller circuit areas and to increase the number of liquid ejection substrates that can be taken from a wafer. The multicolor-integrated type also contributes to shortening a manufacturing period because it can reduce the number of times that the liquid ejection substrate is mounted on the support substrate in the manufacturing process. If the multicolor-integrated type liquid ejection substrate H1500 is used as described above, it is similarly possible to form the conductive layer H1220 over the first surface H1210 of the support substrate H1200, form the flat surface H1221 and then mount the liquid ejection substrate H1500 on the flat surface.

A third variation of the first embodiment is explained below by referring to the accompanying drawings.

Figure 13:
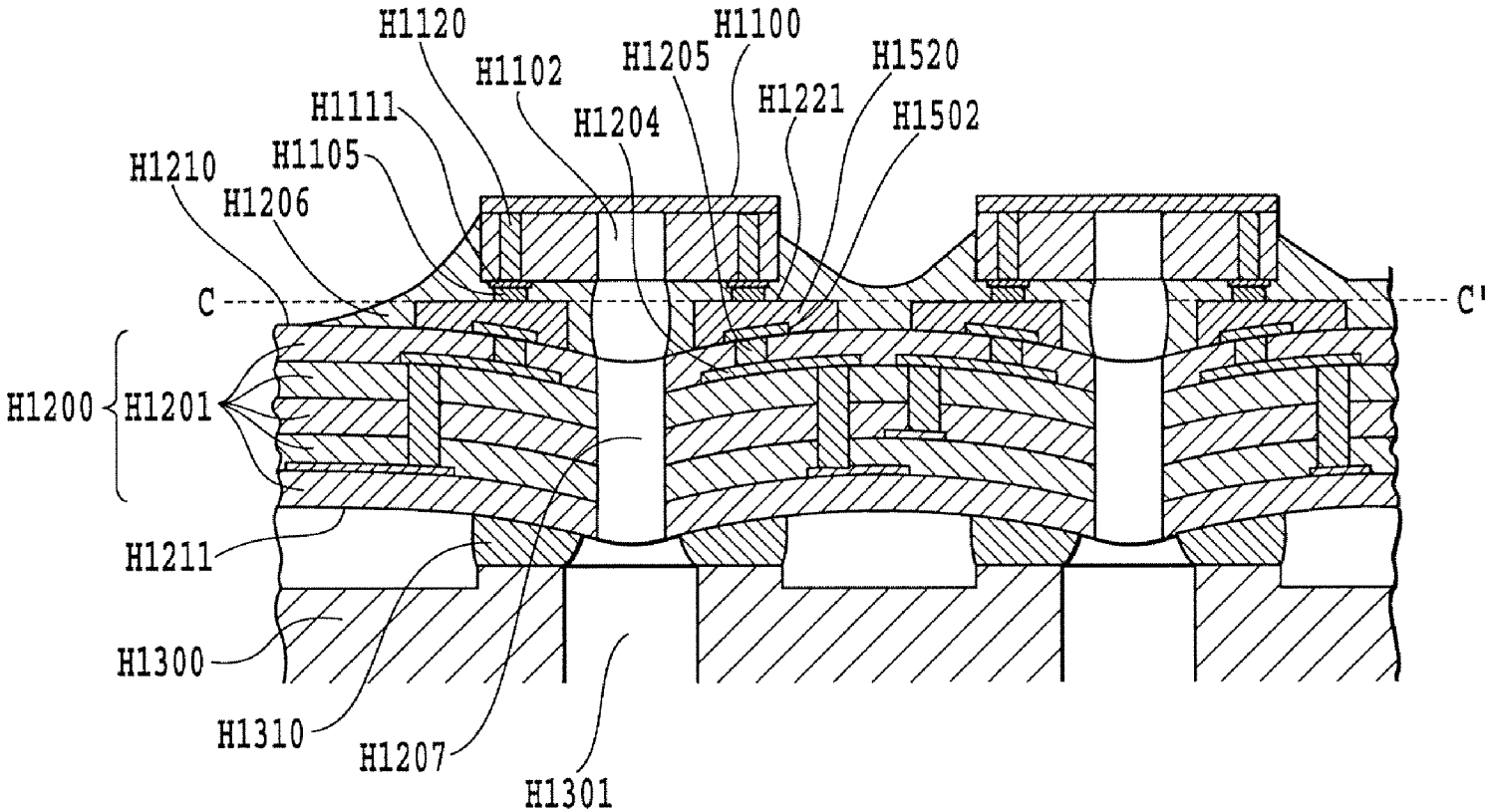
FIG. 13 is a cross-sectional view of a print head as another variation of the first embodiment in which the conductive layer is larger in size than an electrode terminal.
Figure 14:
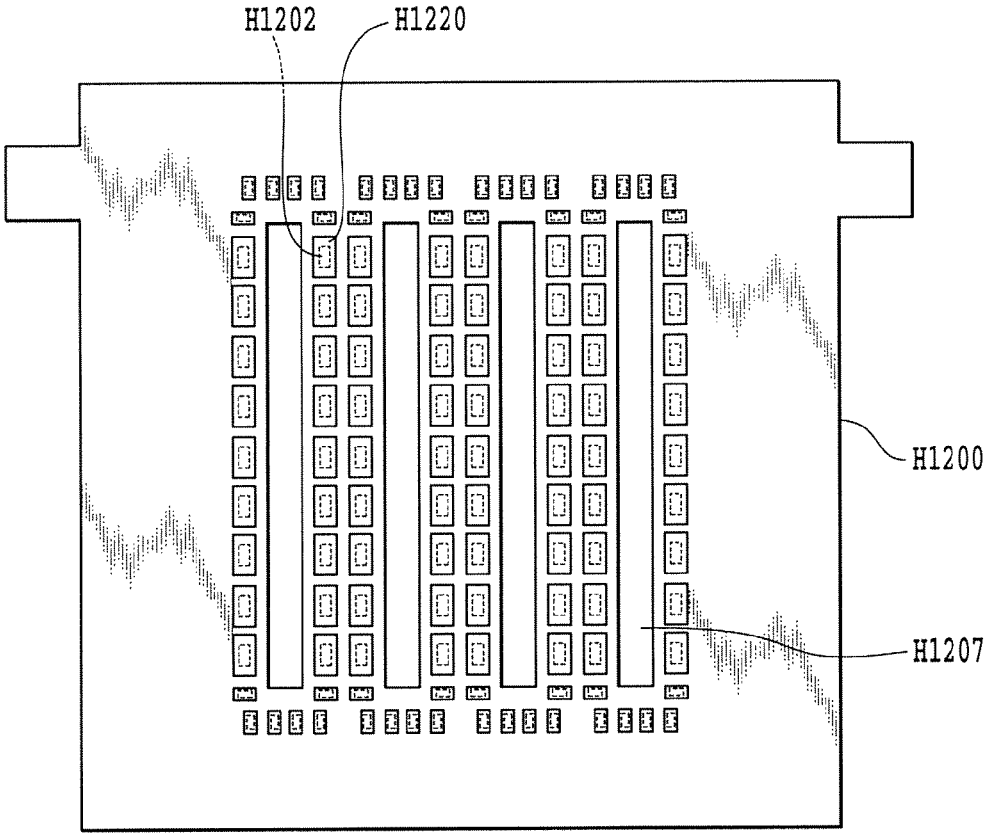
FIG. 14 is a plan view of a conductive layer formed on the support substrate of FIG. 13, as seen from the support surface side of the liquid ejection substrate.

FIG. 13 is a cross-sectional view showing a variation of the print head of the first embodiment in which conductive layers H1520 are larger than the electrode terminals. FIG. 14 is a plan view showing the conductive layers H1520 formed over the support substrate H1200, as seen from the support surface side of the liquid ejection substrate H1100. In the preceding examples, the conductive layers H1220 are smaller than the corresponding electrode terminals H1202, whereas in this variation example, the conductive layers H1520 are larger than and cover the associated electrode terminals H1502. This construction is advantageous where the liquid ejection substrate H1100 is shrunk to reduce the distance between the back side electrode terminals H1111 or where the distance between the liquid supply port H1207 of the support substrate H1200 and the electrode terminals H1502 needs to be reduced. This is because, if the conductive layer H1520 is made smaller than the electrode terminals H1502, the size of the conductive layer H1520 becomes very small, making the application and forming of the conductive material difficult. In this construction also, electrical connection is made between the electrode terminals H1502 and the conductive layer H1520. However, since in this construction there are portions where the conductive layer H1520 directly comes into contact with the first surface H1210 of the ceramic sheets H1201, it is important to select for conductive paste a material capable of intimate contact with ceramics.

A fourth variation of the first embodiment will be explained by referring to the accompanying drawings.

Figure 15:
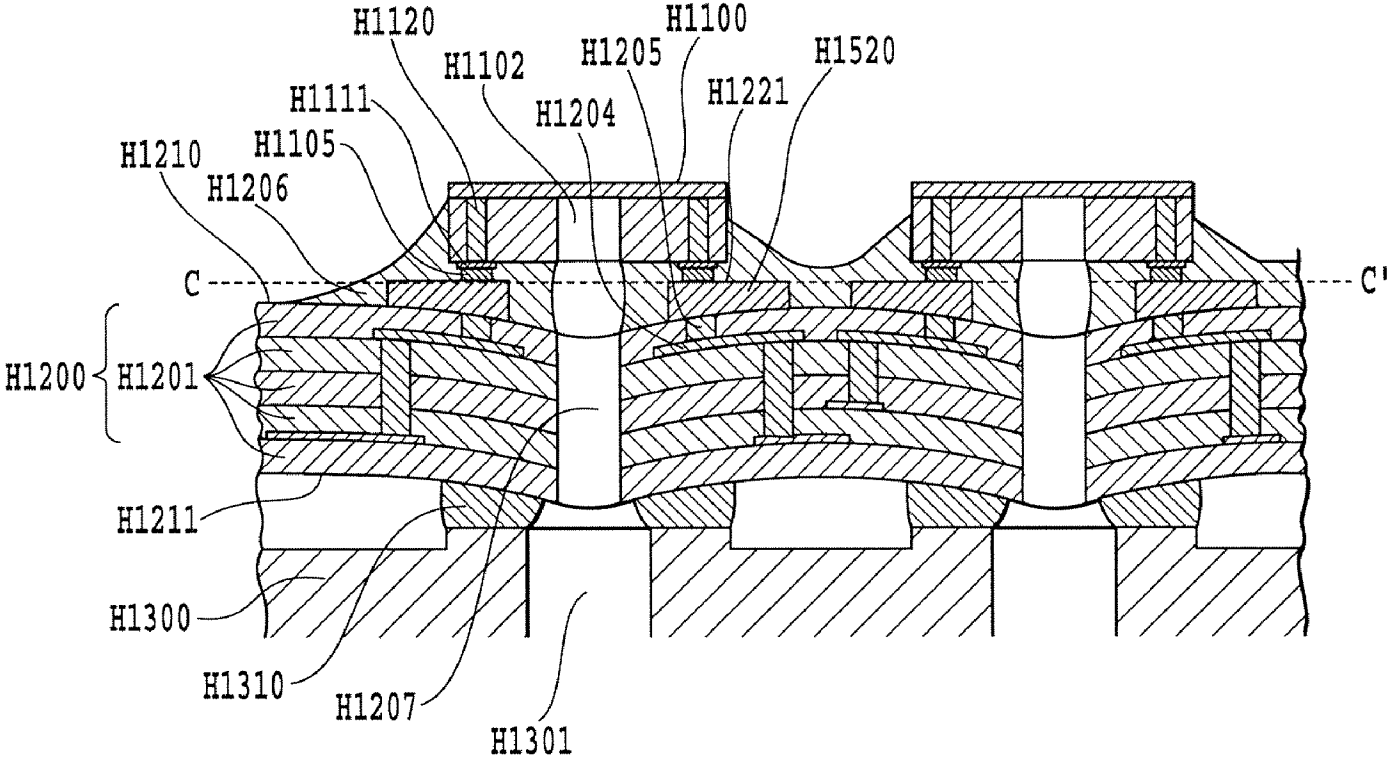
FIG. 15 is a cross-sectional view showing the electrode terminals formed of a conductor of a via hole H1205.
Figure 16:
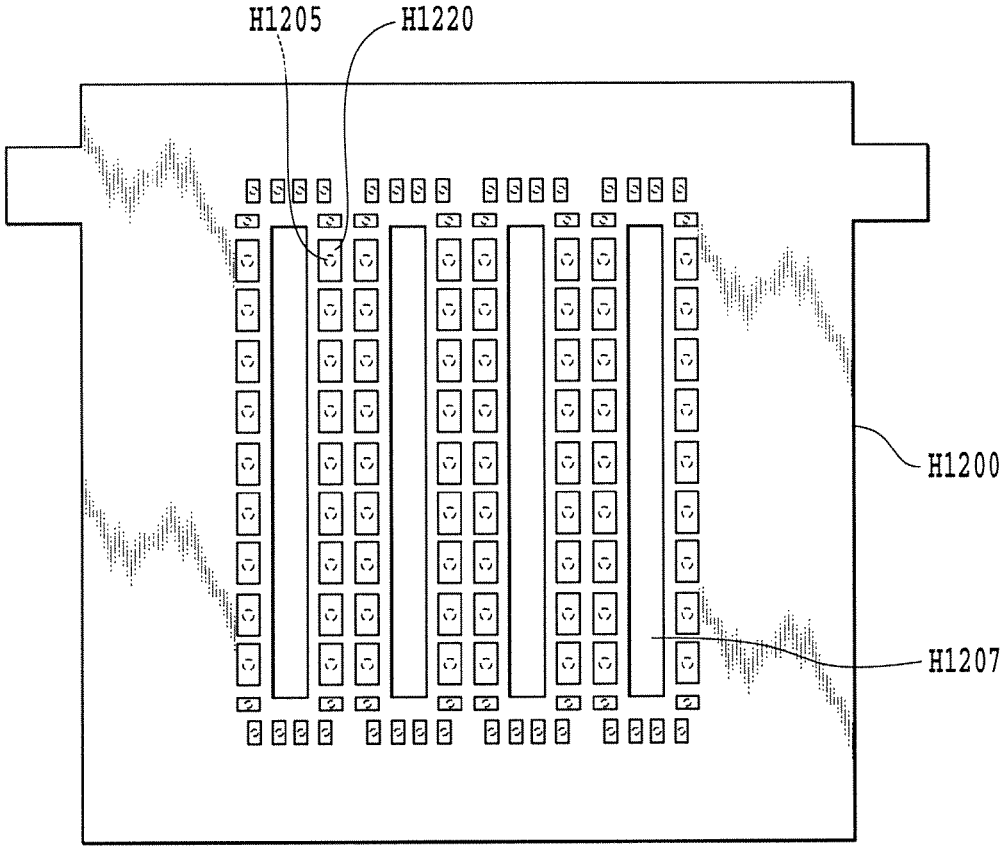
FIG. 16 is a plan view showing a conductive layer formed on the support substrate of FIG. 15, as seen from the support surface side of the liquid ejection substrate.

FIG. 15 is a cross-sectional view of an example construction in which the electrode terminals are formed of only a conductor filled in via holes H1205. FIG. 16 is a plan view showing the conductive layers H1520 formed over the support substrate H1200 of FIG. 15. This construction is advantageous where it is desired to shorten the distance between the back side electrode terminals H1111. The conductive layers H1520 are formed not in the surface wiring layer but directly over the via holes H1205. The upper end of the conductor in the via holes H1205 is used as an electrode terminal.

A fifth variation of the first embodiment will be explained by referring to the accompanying drawings.

Figure 17:
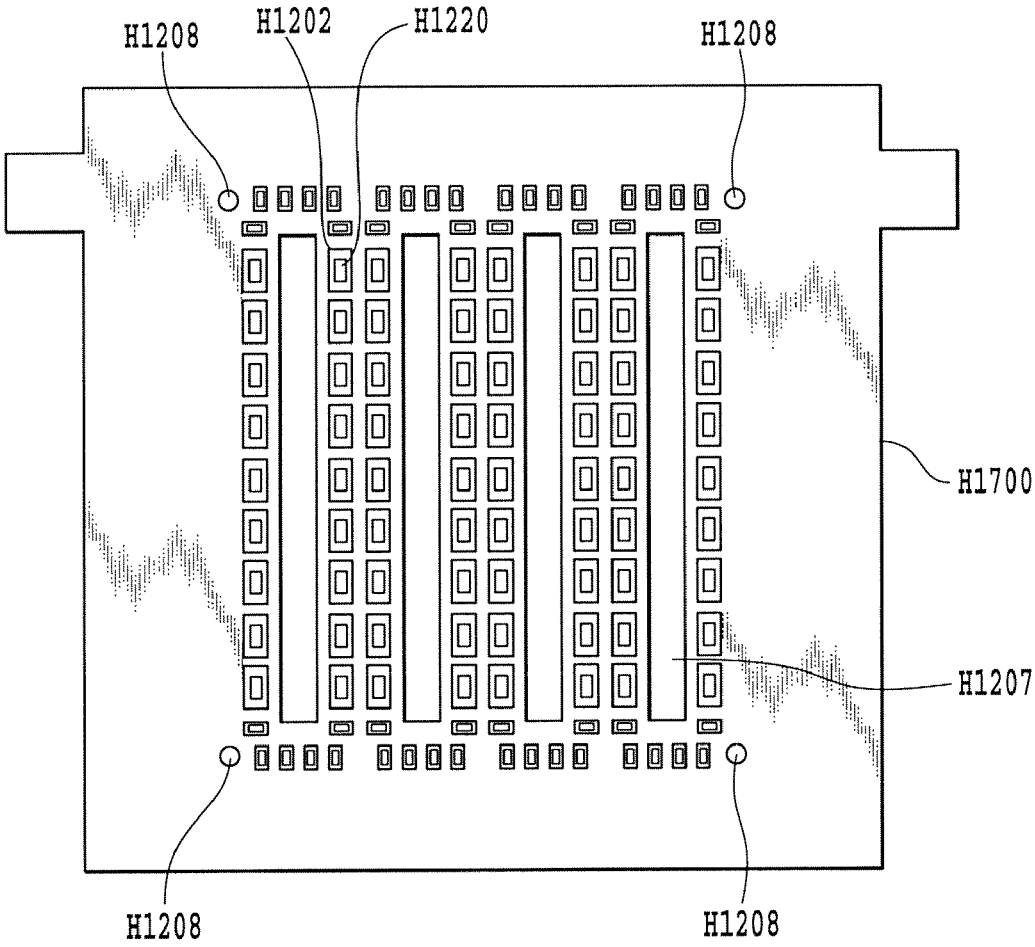
FIG. 17 is a plan view showing alignment marks formed of a surface wire on the support substrate.

FIG. 17 is a plan view showing alignment marks H1208 formed of surface wiring on a support substrate H1700. In the preceding examples, the electrode terminals H1202 or H1502 of the support substrate H1200 are used as a reference in aligning the conductive material application position to form the conductive layers H1220, H1520. Then, with the formed conductive layers H1220 taken as a reference, the liquid ejection substrate H110 is positioned and mounted on the conductive layers. However, depending on the kind of the applied conductive material, the conductive layers may collapse due to spreading or soaking of the conductive material, rendering the high precision positioning impossible. Further, when a conductive material is applied to the inner side of the electrode terminal, there is a possibility that the outlines of the electrode terminal and the conductive material may not be recognized by an image recognition process because they are too close to each other, making the correct positioning impossible. To avoid this possibility, the alignment marks H1208 of the surface wiring layer are formed in addition to the electrode terminals, as in this example. The alignment marks H1208 are used as a reference in aligning the conductive material application position and the mounting position of the liquid ejection substrate H1100, thus allowing for more precise positioning.

Figure 18:
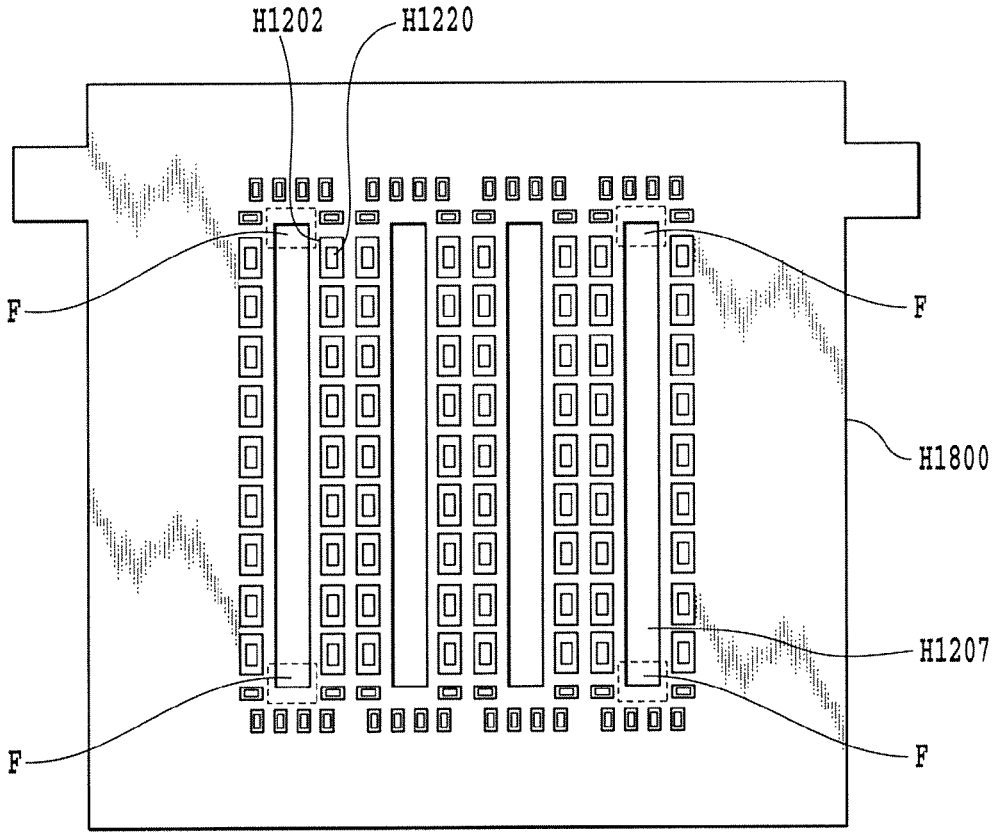
FIG. 18 is a plan view showing ends of a liquid supply port in the support substrate used as alignment references.
Figure 19:
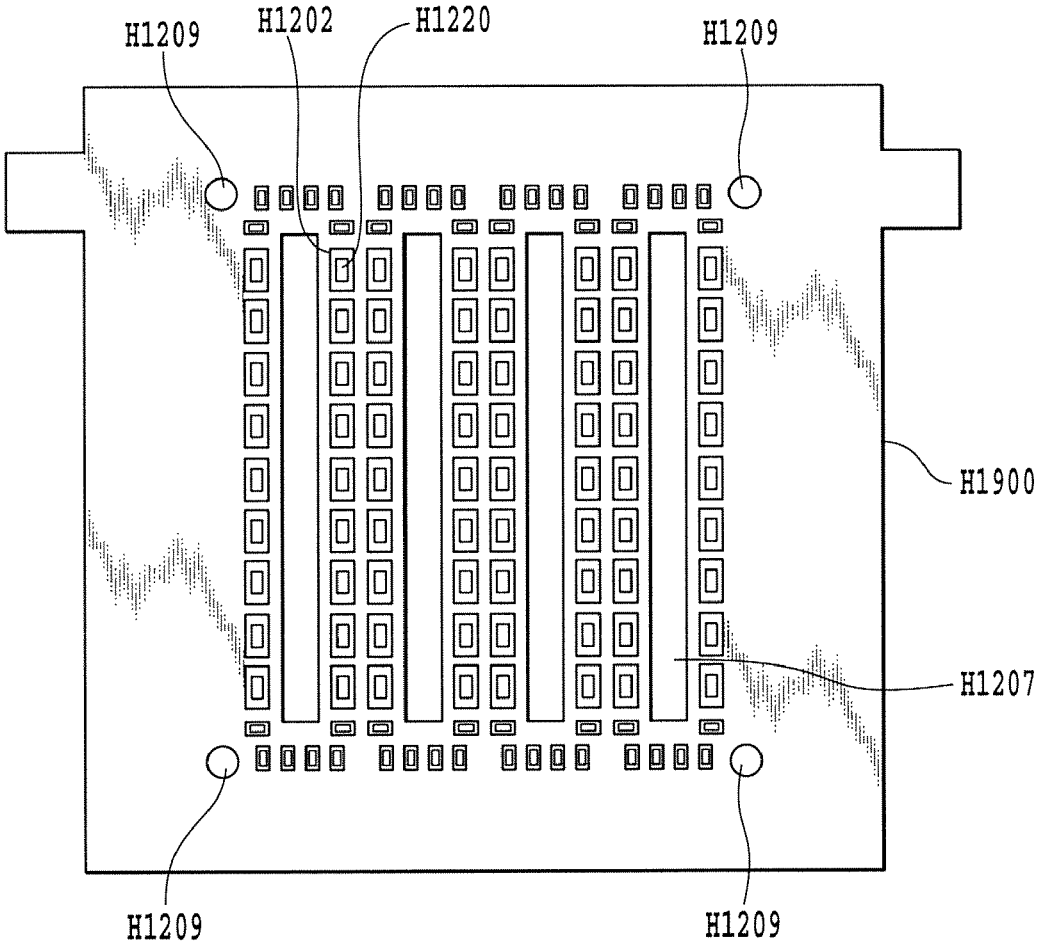
FIG. 19 is a plan view showing alignment holes formed in the support substrate.

FIG. 18 is a plan view of an example construction in which an end of the liquid supply port of a support substrate H1800 is used as a reference for alignment. FIG. 19 is a plan view showing alignment holes H1209 formed in the support substrate H1900. In a process of manufacturing the support substrate H1900, the liquid supply port H1207 and the surface wiring layer are formed in separate steps and thus their relative positional precision may not be good enough. A laminated ceramic substrate such as used in this example, in particular, is sintered at high temperature, so that the relative positional precision of the liquid supply port and the surface wiring layer tends to be degraded. If the conductive material is applied by taking the alignment marks H1208 of the surface wire or electrode terminals as a reference, the relative positional precision of the liquid supply port H1207 and the conductive layer H1220 may not be sufficiently high, giving rise to a possibility of sealing areas failing to be secured depending on locations. To avoid this problem, the ends F of the liquid supply port H1207 in FIG. 18 are used as a reference in aligning the conductive material application position. The ends F may also be used as a reference for mounting the liquid ejection substrate H1100 (H1500).

FIG. 19 shows an example in which alignment holes H1209 are used in place of the liquid supply port as a reference for position alignment. The alignment holes H1209 have their positions defined relative to the ends F of the liquid supply port H1207. With the alignment holes H1209 used as a reference, the conductive material application position is aligned. The alignment holes H1209 may also be used as a reference for mounting the liquid ejection substrate H1100 (H1500).

As described above, the conductive layer H1220 of a conductive material is formed on the support substrate H1200 and planarized, so that the liquid ejection substrate H1100 can be mounted on the conductive layer H1220 with an improved mounting precision, which in turn improves the print quality. Further, the surface of the support substrate H1200 where the liquid ejection substrate H1100 is not mounted is used as a reference in planarizing the conductive layer H1220. This reference is also used as a reference for bonding the ink supply member and for mounting the liquid ejection substrate. Thus, the assembly precision of the entire print head is improved, which in turn improves a precision of ink landing on a print medium. Further, by using the planarized conductive layer H1220 as an electrode, the print head construction can cope with the back surface mounting in which the conductive layer H1220 can be connected to the back surface electrodes of the liquid ejection substrate H1100. In this construction since the sealing agent applied to the connected portions does not protrude from the ejection opening-formed surface, the distance between the ejection opening-formed surface and a print medium can be reduced. Furthermore, since there is no difficulties that would otherwise be posed by the protruding sealing agent, the print head can be cleaned well assuring an improved print quality.

Further, since the conductive layer H1220 of a conductive material is formed over the support substrate H1200 and then planarized, the production cost can be reduced because grinding can be done more easily than with ceramics. Furthermore, the conductive layer H1220 is less prone to cracking during forming and planarizing than is ceramics, thus contributing to improved yield.

Although this embodiment has used electrothermal transducing elements as the ejection energy generation elements, other means such as piezoelectric elements may also be used.

While this embodiment has explained about a case where the print head employs a serial type printing system, the embodiment can also be applied to a full line type print head.

Second Embodiment

An ink jet print head as a second embodiment of this invention will be explained.

Figure 20:
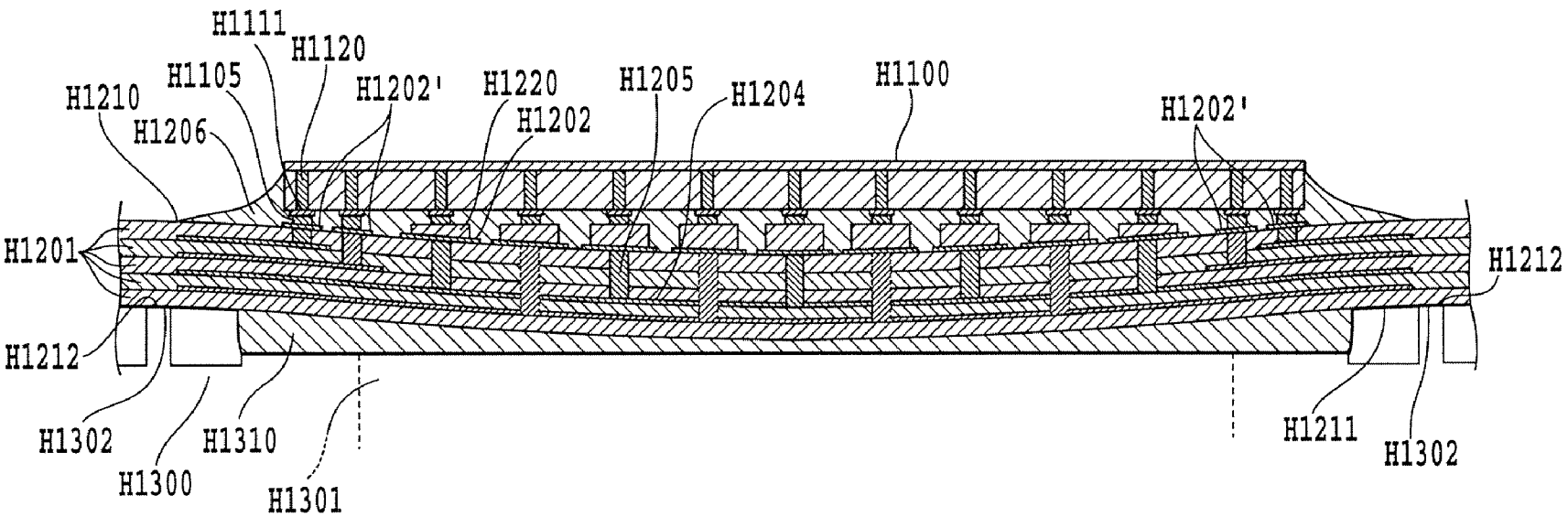
FIG. 20 is a schematic cross-sectional view of a print head as a second embodiment, taken in a direction of an ejection opening array.
Figure 21:
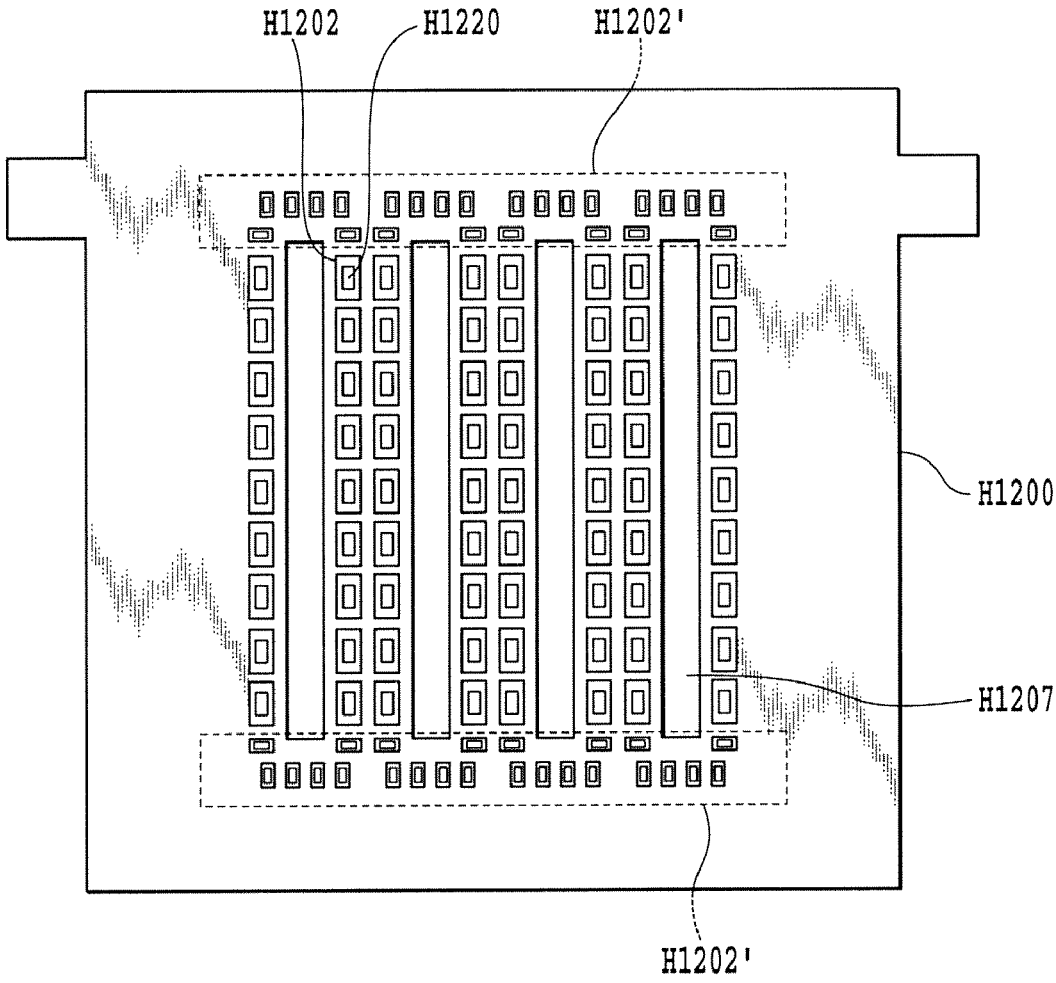
FIG. 21 is a plan view of a conductive layer formed on the support substrate of FIG. 20, as seen from the support surface side of the liquid ejection substrate.

FIG. 20 is a schematic cross-sectional view of a print head as the second embodiment, taken along a direction of an ejection opening array. FIG. 21 is a plan view showing a conductive layer formed on the support substrate of FIG. 20, as seen from a support surface side of the liquid ejection substrate.

In the first embodiment the conductive layer H1220 is formed on all of the electrode terminals H1202 of the support substrate H1200. In this embodiment, however, the conductive layer is not formed on a part of the electrode terminals H1202', with the result that the back surface electrodes of the liquid ejection substrate are directly connected to the electrode terminals of the support substrate with no conductive layer in between. In other respects, the construction is similar to that of the first embodiment.

This construction can be applied where the support substrate is warped convex so that the distance between it and the liquid ejection substrate is small enough to allow electrical connection even without the conductive layer. The conductive layers may be difficult to form at narrow-pitched electrode terminals. Particularly when the narrow-pitched electrodes are arranged on a convex portion of the support substrate, the construction of this embodiment is preferably applied. It is preferred that this construction be applied to a support substrate having an almost constant warping tendency, regardless of a manufacturing lot of the support substrate.

The construction of this embodiment also can improve the planarity of the support substrate, resulting in an improved print quality and a reduced manufacturing cost.

Third Embodiment

A third embodiment of the ink jet print head of this invention will be explained.

Figure 22:
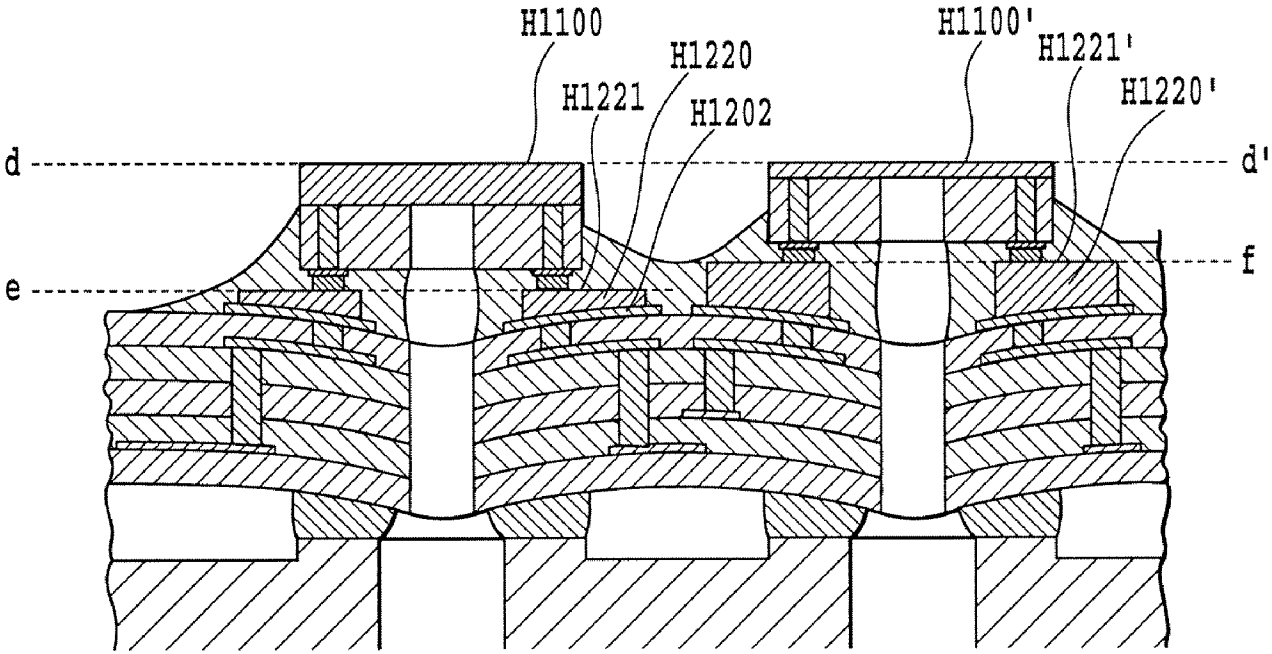
FIG. 22 is a schematic perspective view of a print head as a third embodiment of this invention.
Figure 23:
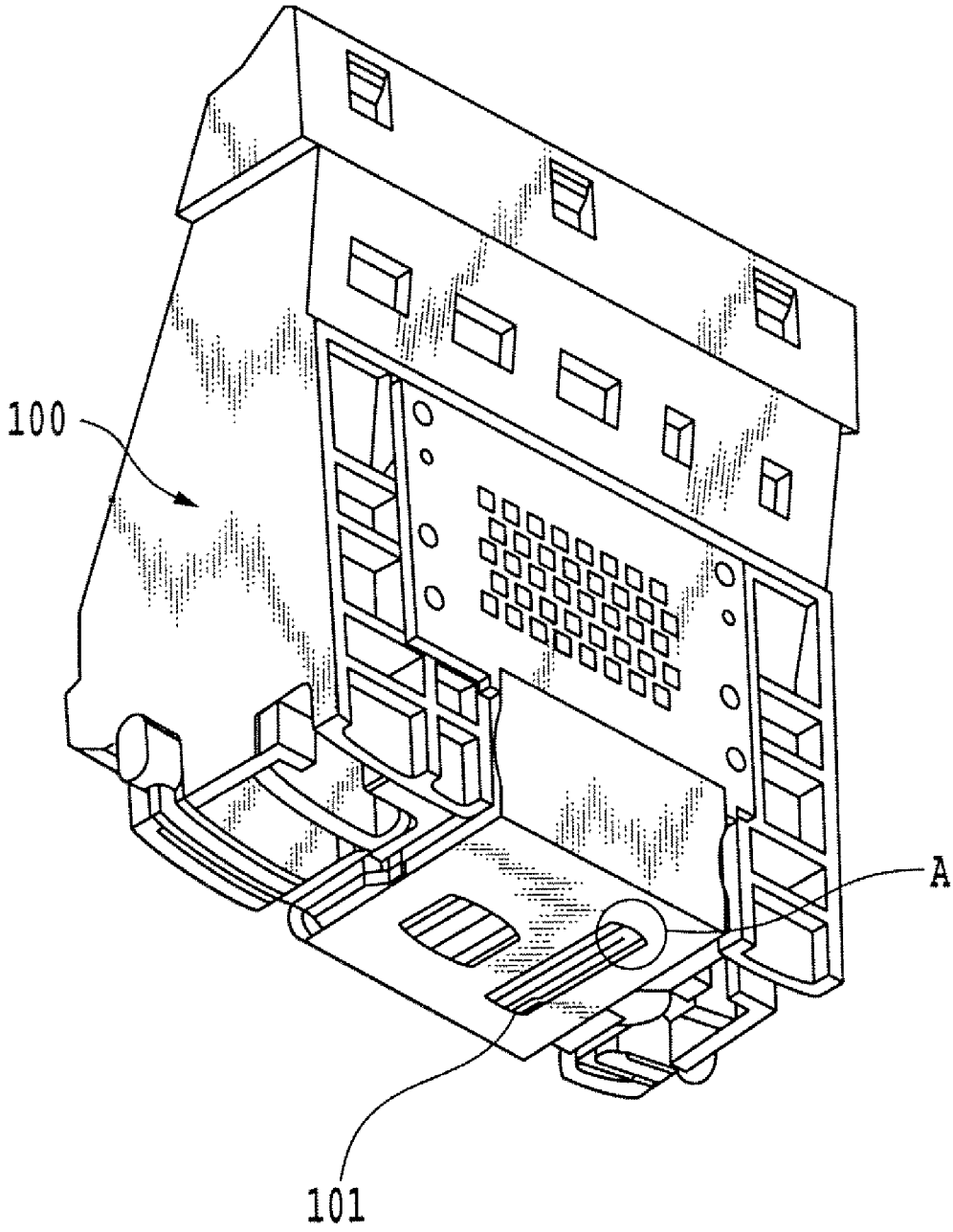
FIG. 23 is a perspective view of an ink jet print head using conventional electrothermal transducing elements.
Figure 24:
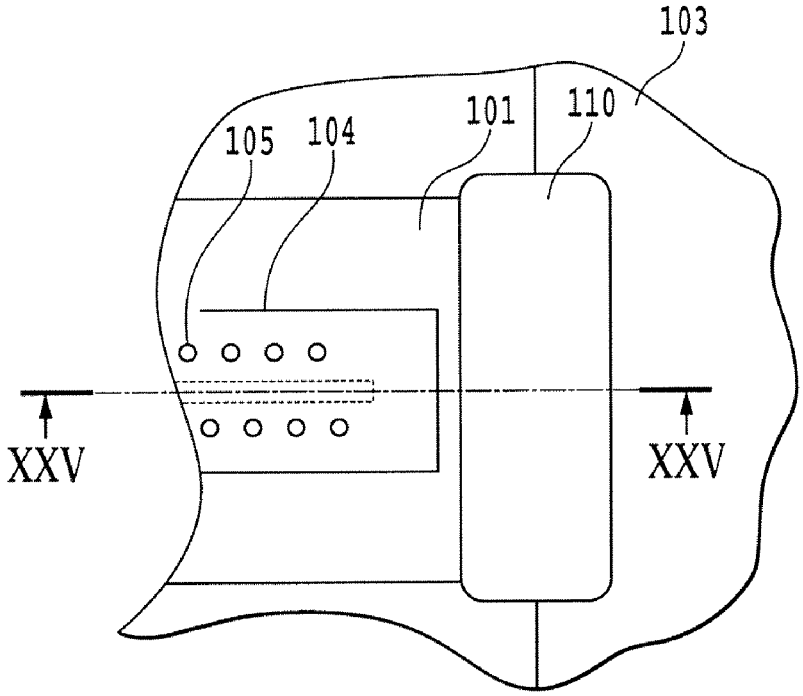
FIG. 24 is an enlarged view of an ink ejection portion of the print head of FIG. 23.
Figure 25:
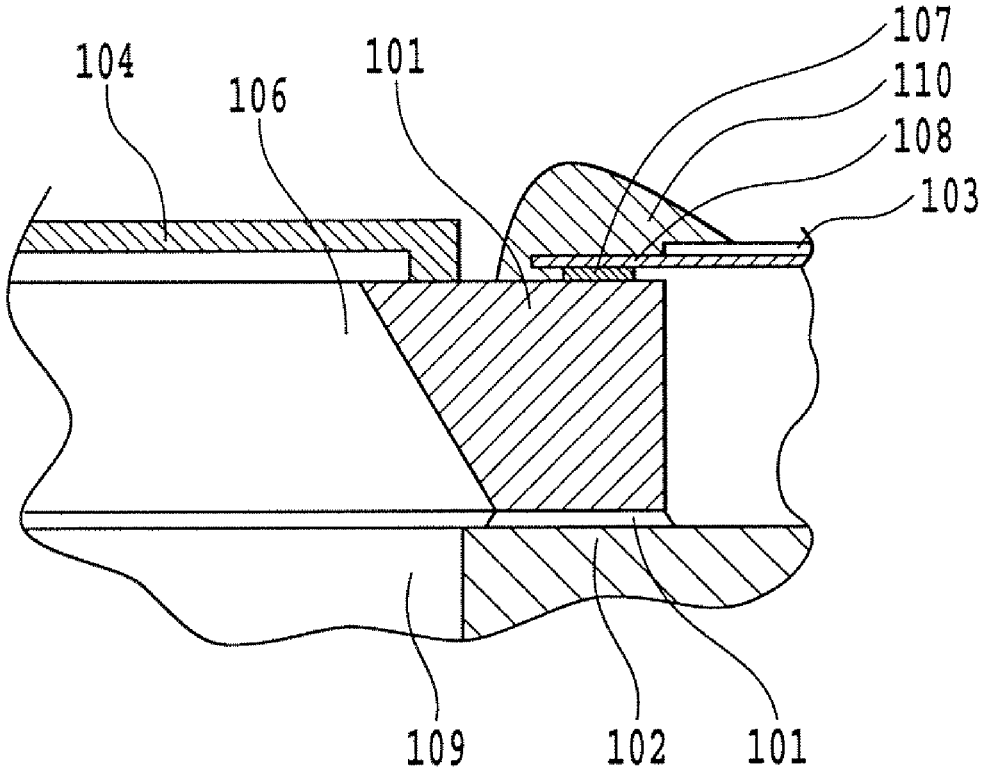
FIG. 25 is a cross-sectional view taken along the line XXV-XXV of FIG. 24.
Figure 26:
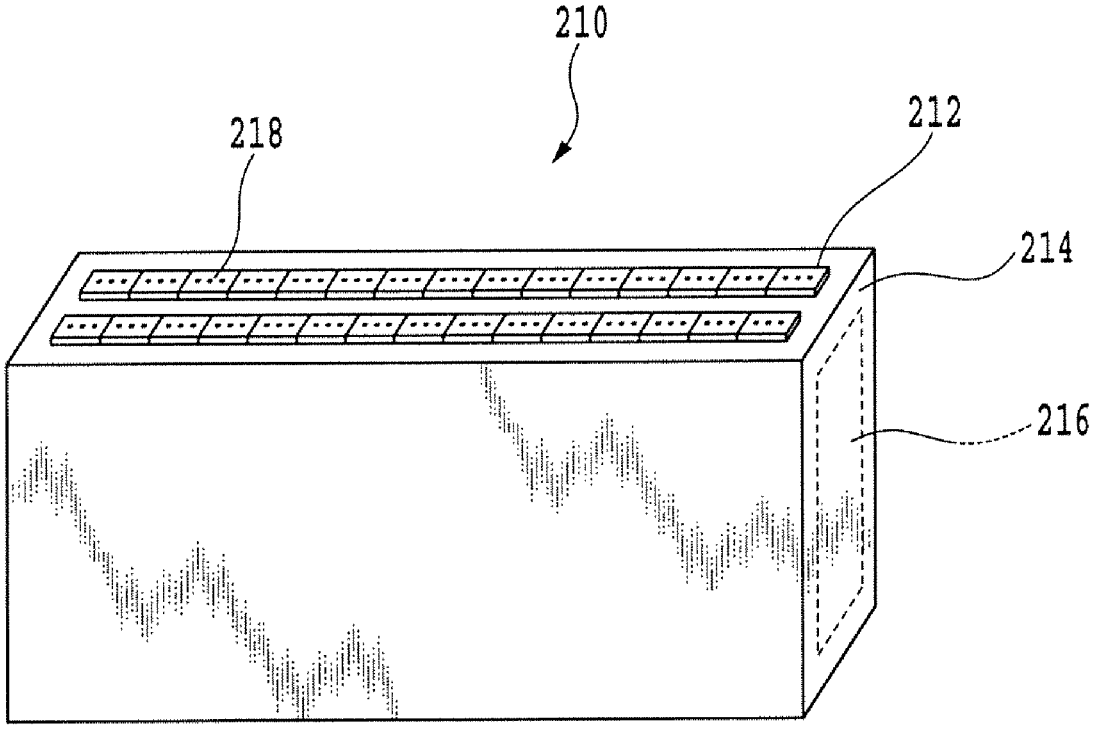
FIG. 26 is a perspective view of a wide array ink jet pen.
Figure 27:
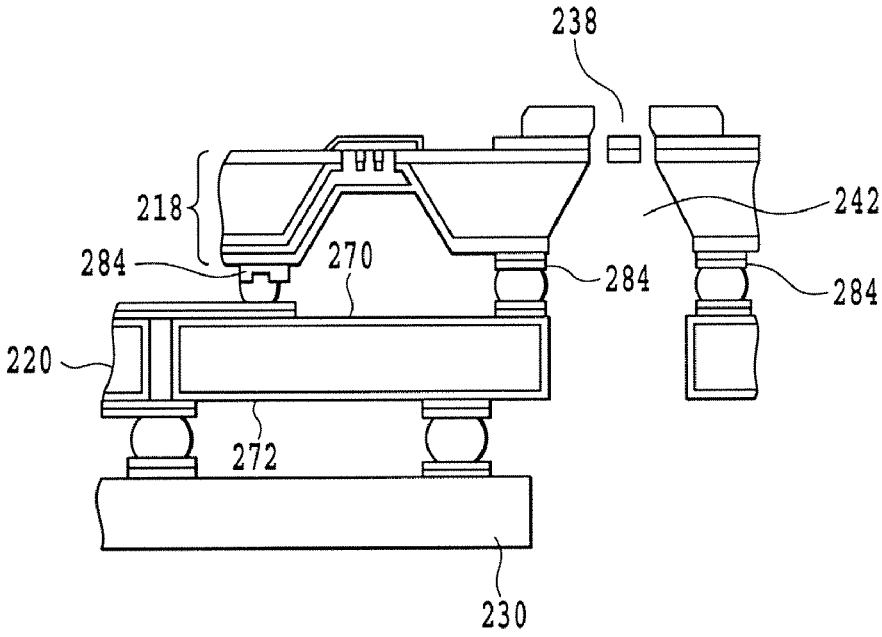
FIG. 27 is a cross-sectional view showing electrical connections of the wide array ink jet print head of FIG. 26.
Figure 28:
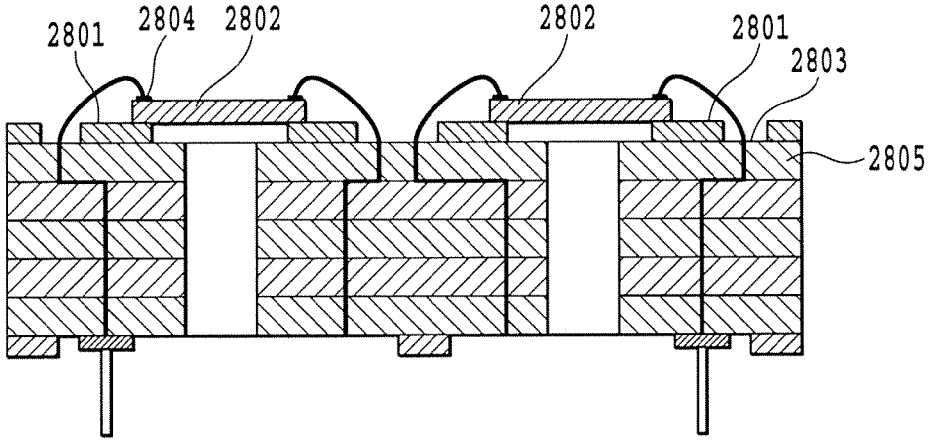
FIG. 28 is a cross-sectional view of a conventional ink jet print head.

FIG. 22 is a schematic cross-sectional view of a print head as a third embodiment of this invention, taken along the line perpendicular to a direction of an ejection opening array. In the first embodiment, a plurality of liquid ejection substrates mounted are uniform in thickness. This embodiment employs a plurality of liquid ejection substrates of different thicknesses. In other respects the construction of this embodiment is the same as the first embodiment.

Liquid ejection substrates H1100 and H1101' differ in thickness. One example case where liquid ejection substrates of different thicknesses are used is when it is desired to differentiate volumes of ejected ink droplets by changing the thickness of a nozzle material. If the liquid ejection substrates of different thicknesses are mounted on a conductive layer of a constant height, such as one used in the first embodiment, the height of the ejection opening-formed surface (front surface) varies from one liquid ejection substrate to another. This makes the blade wiping operation during cleaning difficult and differentiates the distance between the ejection opening-formed surface and a print medium among the liquid ejection substrates. As a result, the liquid ejection substrates with the greater distance may have a degraded ink landing precision.

To avoid this problem, this embodiment provides a difference in height between the planarized surfaces of the conductive layers according to the thickness of the liquid ejection substrate by adjusting the amount of grinding according to the liquid ejection substrate thickness during the conductive layer planarization process. The planarized surfaces are shown at H1220 and H1220' in FIG. 22. With the liquid ejection substrates mounted on such conductive layers of different thicknesses, the ejection opening-formed surfaces of the liquid ejection substrates are on the same plane (d-d' of FIG. 22). As a result, cleaning can be performed well and precise landing of ink droplets assured, thus improving print quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-092428, filed Mar. 30, 2007, which is hereby incorporated by reference herein in its entirety.

What is claimed is:

1. An ink jet print head comprising:

liquid ejection substrates each having back surface electrodes on a surface thereof opposite a surface formed with ink ejection openings; and a support substrate having electrode terminals and supporting the liquid ejection substrates, wherein the back surface electrodes of the liquid ejection substrates and the electrode terminals of the support substrate are electrically connected together through a plurality of conductive layers, wherein surfaces of the conductive layers which contact the liquid ejection substrates are provided substantially parallel to a reference plane of the support substrate, wherein the reference plane of the support substrate is defined by a plurality of reference points provided in the support substrate, wherein alignment marks of a surface wire layer are formed on a surface of the support substrate which has the electrode terminals, wherein a position at which to apply a conductive material to form the conductive layers is aligned by taking the alignment marks as a reference, and wherein the liquid ejection substrates are mounted on the conductive layers by aligning positions of the liquid ejection substrates with the alignment marks as a reference.

2. An ink jet print head according to claim 1, wherein the plurality of reference points are provided on a surface of the support substrate opposite a surface that supports the liquid ejection substrates.

3. An ink jet print head according to claim 1, wherein a planarized surface provided on a surface of the support substrate opposite a surface that supports the liquid ejection substrates is formed of the same material as the conductive layers.

4. An ink jet print head according to claim 1, wherein the support substrate comprises a laminated ceramic substrate comprised of a plurality of laminated ceramic sheets provided with conductive wires and via holes.

5. An ink jet print head according to claim 1, wherein the support substrate is mounted to another component by using a plurality of reference points provided in the support substrate as a reference.

6. An ink jet print head according to claim 1, wherein the conductive layers are provided one on each of a plurality of electrode terminals of surface wires on the support substrate, and wherein areas of contact between the individual conductive layers and associated electrode terminals are smaller than the areas of the electrode terminals.

7. An ink jet print head according to claim 1, wherein the conductive layers are provided one on each of a plurality of electrode terminals of surface wires on the support substrate, and wherein the electrode terminals are covered with the conductive layers.

8. An ink jet print head according to claim 1, wherein the electrode terminals are formed of only via holes filled with a conductive material, and wherein the conductive layers are formed directly over the via holes.

9. An ink jet print head according to claim 1, wherein the support substrate has a liquid supply port extending longitudinally along an array of the electrode terminals, wherein the support substrate is curved so that a surface on which the electrode terminals are not formed is convex, and wherein a longitudinally central part of the liquid supply port forms a vertex of the convex surface.

10. An ink jet print head according to claim 1, wherein the conductive layers are formed by aligning a conductive material application position with a liquid supply port or alignment holes in the support substrate as a reference, positions of the alignment holes being defined relative to the liquid supply port.

11. An ink jet print head according to claim 1, wherein the liquid ejection substrates are mounted on the conductive layers by aligning positions of the liquid ejection substrates with a liquid supply port or alignment holes in the support substrate as a reference, positions of the alignment holes being defined relative to the liquid supply port.

12. An ink jet print head according to claim 1, wherein a portion of the back surface electrodes of the liquid ejection substrates is connected to at least one of the electrode terminals of the support substrate with no conductive layers in between.

13. An ink jet print head according to claim 1, wherein a plurality of the liquid ejection substrates have different thicknesses, and wherein the conductive layers are differentiated in height according to the thickness of the liquid ejection substrates so that the surfaces of the liquid ejection substrates which have the ejection openings are on the same plane after the liquid ejection substrates are mounted on the conductive layers.

14. A method of manufacturing an ink jet print head, wherein the ink jet print head includes liquid ejection substrates formed with ink ejection openings and a support substrate supporting the liquid ejection substrates, wherein back surface electrodes of the liquid ejection substrates and electrode terminals of the support substrate are electrically connected together through a plurality of conductive layers, the method comprising the steps of:

forming the conductive layers so that surfaces of the conductive layers which contact the liquid ejection substrates are provided substantially parallel to a reference plane of the support substrate; and mounting the liquid ejection substrates on the same plane, wherein the reference plane of the support substrate is defined by a plurality of reference points provided in the support substrate, wherein alignment marks of a surface wire layer are formed on a surface of the support substrate which has the electrode terminals, wherein a position at which to apply a conductive material to form the conductive layers is aligned by taking the alignment marks as a reference, and wherein the liquid ejection substrates are mounted on the conductive layers by aligning positions of the liquid ejection substrates with the alignment marks as a reference.

15. An ink jet print head according to claim 1, wherein the surfaces of the conductive layers which contact the liquid ejection substrates are provided after having established the conductive material on the support substrate by grinding the conductive material so that surfaces of the conductive material are substantially parallel to the reference plane.

16. An ink jet print head according to claim 1, wherein at least three of the reference points are provided.

* * * * *